US007331394B2

(12) United States Patent
Edwards et al.

(10) Patent No.: US 7,331,394 B2
(45) Date of Patent: Feb. 19, 2008

(54) AUTONOMOUS WELL INTERVENTION SYSTEM

(75) Inventors: Jeffrey Charles Edwards, Lound (GB); Gavin David Cowie, Banchory (GB)

(73) Assignee: Expro North Sea Limited, Dyce Aberdeen (GB)

( * ) Notice: Subject to any disclaimer, the term of this patent is extended or adjusted under 35 U.S.C. 154(b) by 183 days.

(21) Appl. No.: 10/506,844

(22) PCT Filed: Jan. 16, 2004

(86) PCT No.: PCT/GB2004/000138

§ 371 (c)(1),
(2), (4) Date: Apr. 25, 2005

(87) PCT Pub. No.: WO2004/065757

PCT Pub. Date: Aug. 5, 2004

(65) Prior Publication Data

US 2005/0217844 A1 Oct. 6, 2005

(30) Foreign Application Priority Data

Jan. 18, 2003 (GB) ..... 0301186.3

(51) Int. Cl.
*E21B 7/12* (2006.01)

(52) U.S. Cl. ..... 166/339; 166/365; 166/75.15

(58) Field of Classification Search ..... 166/338, 166/339, 365, 351, 75.15
See application file for complete search history.

(56) References Cited

U.S. PATENT DOCUMENTS 4,444,275 A * 4/1984 Beynet et al. ..... 175/7
6,056,058 A * 5/2000 Gonzalez ..... 166/310
6,394,192 B1 * 5/2002 Frazer ..... 175/58
6,454,011 B1 * 9/2002 Schempf et al. ..... 166/381

(Continued)

FOREIGN PATENT DOCUMENTS

GB 2 365 894 A 2/2002
GB 2 375 785 A 11/2002

OTHER PUBLICATIONS

International Search Report (ISR) for PCT/GB2004/000138, mailed Jul. 16, 2004.

*Primary Examiner*—Thomas A Beach
(74) *Attorney, Agent, or Firm*—Momkus McCluskey, LLC; Jefferson Perkins

(57) ABSTRACT

A self-contained well intervention system which can be deployed from a lightweight vessel and coupled directly to a wellhead is described. The system includes valve means for providing a suitable well barrier and sealing the intervention system to allow an emergency disconnect. Within the intervention system, a tool magazine is provided which contains at least one deployable intervention tool. The intervention system also contains a tool selection and deployment means based on a winch located in close proximity to the magazine and which is operable from the surface for selecting a particular tool from the magazine and for deploying the selected tool through the intervention system and the wellhead into the well. The tool magazine has a plurality of magazine pockets each of which may have a deployable tool therein. The tool selection and deployment means can be used to select and to join the selected tools together within the intervention system to form an intervention tool string which can be run into the wellhead so that a plurality of different operations can be performed within the well during an intervention.

45 Claims, 17 Drawing Sheets

Figure 1A:
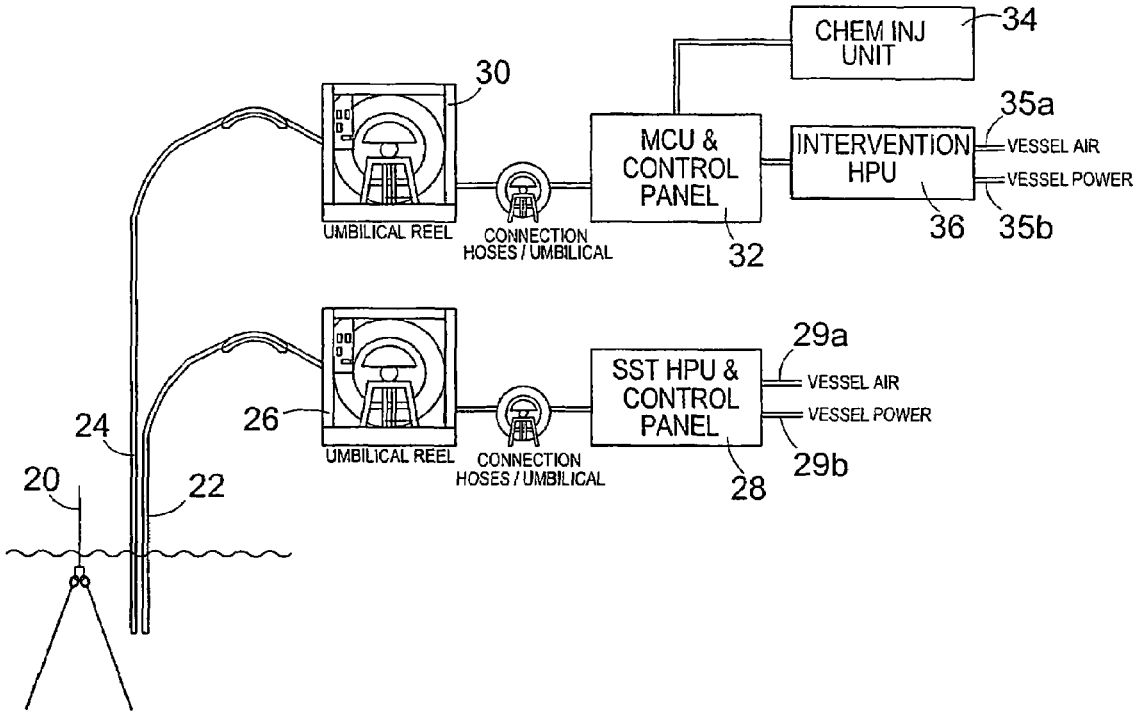

U.S. PATENT DOCUMENTS 6,457,526 B1 * 10/2002 Dailey ..... 166/338
6,488,093 B2 * 12/2002 Moss ..... 166/339
6,659,180 B2 * 12/2003 Moss ..... 166/339
6,763,889 B2 * 7/2004 Rytlewski et al. ..... 166/338
6,808,021 B2 * 10/2004 Zimmerman et al. ..... 166/381
7,036,598 B2 * 5/2006 Skjærseth et al. ..... 166/339
2002/0066556 A1 * 6/2002 Goode et al. ..... 166/53
2002/0134552 A1 9/2002 Moss
2003/0178200 A1 * 9/2003 Fox et al. ..... 166/341
2004/0094305 A1 * 5/2004 Skjærseth ..... 166/339

* cited by examiner

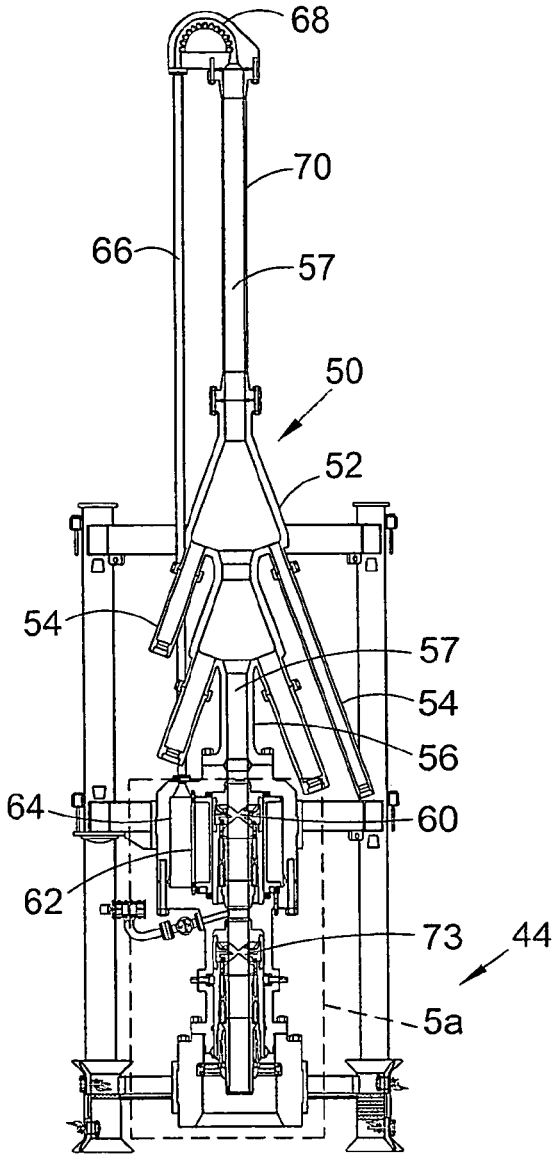
Fig.3b
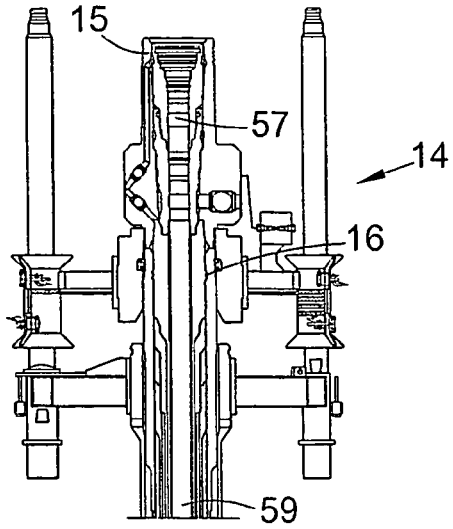

AUTONOMOUS WELL INTERVENTION SYSTEM

The present invention relates to subsea production systems and particularly to an intervention system for use with subsea production systems.

The past decade has seen the use of subsea production systems become the method of choice for exploiting-offshore oil and gas fields. The use of these systems offers significant advantages over traditional platform based production methods in terms of both economics and reservoir management. A significant step change in subsea production systems occurred with the introduction of the "spool" or horizontal production tree. The introduction of this equipment has enabled the use of large bore completions and subsequently multi-lateral wells and has led to a considerable reduction in the number of wells required to fully exploit an offshore field. These subsea systems also reduce capital expenditure and operating expenditure by enabling completion and intervention operations to be conducted via a traditional drilling riser and BOP, as opposed to the dual skeletal riser normally associated with conventional subsea production trees.

Many of the fields developed with subsea trees are now moving into the second phase of production—the intervention phase. Extensive production logging programmes are typically required followed by the appropriate remedial operations, such as re-perforating and water shutoff. The requirement for and difficulty of these operations is increased by the complexity of reservoirs both developed and planned. The very nature of multi-lateral wells, with long horizontal sections undulating through the producing section require the regular deployment of complex intervention tooling. The number and complexity of intervention operations conducted (and consequently field economics) is significantly conditioned by the confidence in the integrity of the intervention system equipment.

In the formative era of subsea production systems, it was envisaged that intervention operations would be conducted from a drilling rig or ship via a marine riser and BOP. In the case of horizontal trees, a large bore work over riser and Lower Riser Package (LRP) could also be used and for conventional trees, a skeletal riser and LRP. However, the use of a conventional drilling vessel to conduct intervention operations is not only subject to limited vessel availability but also involves considerable cost implications. Not only are the operating costs of a drilling rig high in themselves but also the additional costs incurred by the increased complexity of mooring in close proximity to production facilities and infrastructure have to be considered.

Although many different types of lightweight intervention vessels have been reviewed, only one—the Stena Seawell—has reached the market. This vessel has been operating in the UK and Norwegian sectors for over ten years and has conducted a considerable number of well intervention operations. These include activities such as well logging, preparation for well abandonment etc. With one exception, all of these operations have been conducted with either slick or electric line via a subsea lubricator system. Although the inability to deploy coiled tubing limits the flexibility of the vessel, the Seawell has great demand for its services and consequently commands premium rates (as high as £100,000 per day with mobilisation charges between £300,000 and £500,000), therefore offering little commercial advantage over the use of a traditional vessel. The major benefit provided by the Seawell is the ability to operate without the requirement to install and set anchors.

Other companies are now close to bringing intervention vessels to the market. The Seawell will soon be joined by an upgraded Aker H3—the Regalia (operated by Prosafe and Kongsberg on contract to Statoil in the Norwegian sector). A Norwegian shipping company is also currently conducting a marketing survey for an additional vessel utilising a Suez class tanker as the platform for through riser interventions. This concept offers an extremely stable intervention platform with transfer values of approximately 60% of a semi-submersible and consequently enables wire, coil and work-over string interventions. It is believed that the target market for this vessel is the more challenging areas such as the West of Shetlands and central and northern Norwegian North Sea.

It is believed that the UK and Norwegian markets can support a fleet of at least three to four intervention vessels. The number of subsea wells currently stands in excess of 800 with over 100 wells being added each year. It is believed that in excess of 80% of the undeveloped discovered/known oil reserves lie within tie back distance of existing infrastructure and will be exploited by subsea systems. The same applies to new developments in the Norwegian sector where many of the new prospects are located either in developed areas or in the northern Norwegian or Barents Sea in water depths too great for economic developments by conventional platforms.

The average intervention time for an intervention programme conducted from the Seawell is of the order of five days with an additional two days for mobilisation and demobilisation. This equates to approximately 40 to 50 interventions per year per vessel. Assuming a total well population of 1000 by 2004 with an optimum intervention frequency of three years, this generates about 300 interventions per year or a requirement for six vessels. Whilst the number of intervention vessels remains below this number optimum rates will continue to be available.

A major influence on intervention policy is the ability to deploy the system and conduct operations from a lightweight vessel. Many studies have been conducted to establish the economic and operational integrity of conducting interventions from a lightweight semi or mono-hull vessel. The size of these vessels preclude the user of a marine riser and BOP stack, requiring the deployment of sub surface lubricator system or skeletal riser system. On fields completed with conventional production trees, well control is achieved by a combination of barriers contained within the intervention system and the production tree. This enables full flexibility of well containment and even the complete retrieval of the intervention equipment enabling heavy duty intervention and well control operations is conducted. The valves contained within the vertical bore of the production tree provide an acceptable barrier standard. However, when conducting similar operations on a horizontal tree which has no vertical isolation capability (both tubing hanger and tree cap plugs are removed to allow intervention string access), the only vertical barrier solution available is contained within the intervention system itself. Under normal circumstances this meets with accepted barrier requirements and provides the ability to remove the intervention equipment or deploy a BOP for well kill or fishing operations. The inability to retrieve the intervention equipment and maintain an acceptable barrier is a challenge which must be overcome before well operations on horizontal trees can safely be performed from a lightweight vessel.

Several different concepts to improve the integrity of lightweight intervention operations on horizontal trees have been proposed. These concepts include the deployment of a drilling BOP prior to heavy-duty fishing and well kill operations commencing. All the concepts utilise an additional BOP connector, ram and spool with the well barrier being provided either by a full bore shear/blind ram or an integral valve which is hydraulically operated, enabling the intervention system to be retrieved and then a drilling BOP stack and marine riser to be run. The additional spool and connector add considerable weight to the intervention system dictating the use of vessels much larger than those normally associated with lightweight intervention techniques and also minimise the weather envelope available for system deployment. The introduction of an additional connector and spool between the production tree and the drilling BOP significantly increases the bending moment at the production tree precluding the use of this system in all but benign environments.

To some extent the use of a fixed riser system with a lower riser package, currently under development by Norsk Hydro and Statoil for use in the Norwegian sector, addresses the well kill issues and therefore enables the retrieval of the LRP and the installation of a BOP. However, in the event of a LRP system failure (the most likely event to require well kill) substantial ROV (remotely operated vehicle) operations are required which is a time consuming operation. This time is not available in the event of a major well control issue and/or deteriorating environmental conditions. Without substantial modification neither of these systems could be deployed from a lightweight vessel and even then they would still require a substantial vessel. An additional consideration is that operation uptime studies indicate that fixed riser systems deployed from monohulls in the 100 to 150 meter range have a winter operating uptime as little as 6% in harsh environmental areas such as the west of Shetlands and northern Norwegian North Sea.

There is, at present, no suitable horizontal tree intervention system which provides the required well barrier and which is deployable from an economically viable vessel, i.e. a lightweight vessel such as an anchor handler of about 2000 tonnes displacement with a dynamic positioning system of class 2 or better.

An object of the present invention is to obviate or mitigate at least one of the disadvantages of the aforementioned lightweight intervention systems.

This is achieved by providing a self-contained well intervention system which can be deployed from a lightweight vessel and coupled directly to a wellhead. The invention system includes valve means for providing a suitable well barrier and sealing the intervention system to allow an emergency disconnect. Within the intervention system, a tool magazine is provided which contains at least one deployable intervention tool. The intervention system also contains a tool selection and deployment means based on a winch located in close proximity to the magazine and which is operable from the surface for selecting a particular tool from the magazine and for deploying the selected tool through the intervention system and the wellhead into the well.

The tool magazine has a plurality of magazine pockets each of which may have a deployable tool therein. The tool selection and deployment means can be used to select and to join the selected tools together within the intervention system to form an intervention tool string which can be run into the wellhead so that a plurality of different operations can be performed within the well during an intervention.

According to a first aspect of the present invention, there is provided a self-contained well intervention system for use with a well intervention tool, said system comprising:

a well intervention housing having a tool magazine having a magazine housing, at least one magazine pocket for storing at least one deployable tool therein and a magazine chamber for assembling an intervention tool string therein, a valve housing coupled to said magazine housing, said valve housing having a detachable valve means coupled thereto, said well intervention housing and said valve means each having a coupling means for coupling the intervention housing and said valve means to a top portion of the subsea xmas tree, said well intervention housing, valve housing and valve means defining an intervention system throughbore for permitting passage of intervention tools, tool selection and deployment means coupled to said well intervention housing and being remotely operable from the surface for selecting and retrieving a tool from said magazine and for deploying said tool through said intervention system throughbore into a wellbore.

Preferably, said magazine includes a plurality of tool compartments for receiving and storing a plurality of tools selectable from the surface.

Preferably also, said intervention system includes a tool support means for supporting a selected tool permitting at least one other tool to be selected and coupled to said support tool to provide a deployable tool string of at least two tools.

Preferably, wherein said tool selection and deployment means includes a rotatable drum having a length of slickline or wireline wound thereon, a sheath for guiding slickline or wireline from the drum to the tool and coupling means for coupling the slickline or wireline to the tool.

Preferably also, the rotatable drum is coaxially mounted on said central bore.

Preferably, said well intervention system includes at least two separate lubricator conduits are provided, one conduit coupled between said drive housing and said sheave for conveying wire from the rotatable driver to the sheave, and another lubricator conduit coupled between the sheave and said tool magazine for deploying a tool string and wire from said sheave.

Preferably, said tool selection and deployment means includes coupling means adapted to be operated from the surface to retrieve a selected intervention tool from said magazine and to couple the selected tool to at least one other intervention tool in order to create a tool string to run the tools into the well, the coupling means also being actuatable from the surface to de-couple the tools to permit said tools to be replaced into the magazine.

Preferably also, wherein said tool magazine comprises a magazine housing, a plurality of tool magazine pockets coupled to and disposed about said housing, said tool magazine pockets each being adapted to receive at least one respective tool.

Conveniently, said tool magazine pockets are radially disposed about said housing. Advantageously, said magazine pockets are releasably coupled to said housing whereby a particular magazine pocket can be removed and replaced by a blank plate means so as to vary the number of magazine pockets being deployed on a full magazine.

Preferably, said magazine pockets are selectively sealable and disconnectable from said magazine housing, whereby the same magazine product or a different product is connectable to said magazine housing.

Preferably also, said tool magazine and said magazine pockets each have remotely actuatable means for moving a tool stored in the magazine pocket from a position of storage in said magazine to a coupling position for coupling to the tool selection and deployment means to assist the tool to be coupled to said tool selection and coupling means.

Conveniently, said remotely actuatable means are used to lower the tools back into respective magazines after the tool has been used in well intervention.

Conveniently, said magazine actuating means are provided by hydraulically operated rams, each hydraulically operated ram being associated with a respective magazine pocket. Alternatively, the magazine actuating means are provided by electrically or mechanically operable rams, each ram being associated with a respective magazine pocket.

Preferably, said valve means is coupled to said housing by locking means, said locking means being remotely actuatable from the surface.

Conveniently, the locking means is hydraulically, mechanically or electrically operable and preferably by an ROV.

Preferably also, said locking means are provided by a plurality of moveable dogs which pass through said valve housing and engage with said valve means. Conveniently, said coupling means for coupling said valve means to the wellhead includes locking means for locking said valve means to the interior of the wellhead.

Preferably, said locking means includes an axially moveable sleeve or mandrel and moveable dogs, whereby in response to axial movement of said sleeve the dogs are radially displaced to engage an inner profile of said wellhead and lock said valve means to said wellhead to allow the well intervention housing to be removed.

According to yet another aspect of the present invention, there is provided a tool selection and deployment means for use with a self-contained well intervention system, said tool selection and deployment means including remotely actuatable coupling means for controlling said tool selection and for selecting a particular intervention tool from a magazine for coupling the tool to a tool string for deployment in a well, said coupling means being adapted to engage with an upward portion of the respective deployable tool to secure said deployable tool to said tool string.

Preferably, said tool selection and deployment includes support means for supporting at least one selected tool in a bore and allowing said coupling means to be separated from said tool to retrieve a further tool selected from said magazine to create a tool string with at least two deployable tools therein, said coupling means and said tool support means permitting separation of said selected tools after well intervention and restoring said tools in their respective magazines.

Preferably also, said tool selection and deployment means includes a rotatable drum having a length of slickline or wireline wound thereon, a sheave for guiding slickline or wireline from the drum to the tool and coupling means for coupling the slickline or wireline to the tool and drive means.

Preferably, said drum is coaxially mounted on said central bore.

Preferably also, at least two separate lubricator conduits are provided, one conduit coupled to between said drum housing and said sheave for conveying wire from the rotatable driver to the sheave, and another lubricator conduit coupled between the sheave and said tool magazine for deploying a tool string and wire from said sheave.

Conveniently, said first lubricator conduit is a small bore intervention section coupled to said second lubricator conduit.

Preferably, said rotatable drum and said tool string are disposed within a common pressurised housing.

Preferably also, said rotatable drum and spool arrangement is mounted parallel to said drum and driven directly from the drum rotation.

Conveniently, said tool selection and deployment means includes a mechanical drive system, rotating said rotatable drum, said mechanical drive system being located outside said pressure container housing.

According to another aspect of the invention, there is provided a tool magazine for use with a self-contained well intervention system, said tool magazine comprising a magazine housing, a plurality of magazine pockets coupled to said tool magazine, each magazine pocket being adapted to receive a respective well intervention tool and each magazine pocket having actuation means for moving said tool from the magazine pocket to a position for engagement with a tool coupling means.

Preferably, said tool magazine pockets are radially arranged around said magazine housing.

Conveniently, said magazine pockets are partially included to a well axis.

Advantageously, said magazine housing is substantially coaxial with the wellbore bore axis and each magazine pocket is adapted to contain an independent tool holder which is moveable to cross said wellbore bore axis.

Preferably, the length of each magazine pocket is adjustable to accommodate a variety of different tool lengths.

Preferably also, each magazine pocket has remotely actuatable means for moving a tool stored in a magazine pocket for a position of storage in said magazine to a coupling position for coupling to the tool selection and deployment means to assist the tool to be coupled to said tool selection and coupling means, said coupling position being substantially aligned with the vertical axis of the wellbore.

Conveniently, the lower part of each pocket contains a hot-stab mechanism to allow coupling of a device for interrogation of logging tools.

Preferably, at least one of said magazine pockets is sealable by barrier seal to allow the tool in the magazine pocket to be changed by removing the magazine pocket from the magazine housing or removing the tool from the magazine pocket and replacement by another tool.

Conveniently, said magazine pockets are releasably coupled to said housing whereby a particular magazine pocket can be removed and replaced by a blank plate so as to vary the number of magazine pockets being deployed in a magazine.

Preferably said, said valve means is capable of being either a) retrieved with the system or b) remaining locked onto the wellhead.

Conveniently, said system incorporates a further well barrier wholly within the pressure boundary of the system.

Advantageously, the valve means is provided by an apertured improved ball valve.

According to a further aspect of the present invention, there is provided a coupling system for use with a well intervention system for coupling tools disposed in the magazine of said well intervention system and for disposing said selected tools in an intervention tool string for use in well intervention, said coupling system comprising:

a coupling member adapted to be coupled to a wireline, said wireline being coupled to a rotatable winch drum which is controllable from surface to vary the position of the coupling means in said magazine;

a coupling head disposed on each deployable tool, said coupling head being disposed in a coupling position in response to the tool being selected and moved to a said make-up position;

moveable support means within said magazine having shoulders for abutting said coupling member and for abutting said selected tool coupling head, the tool coupling means and the selected tool each having spring-biased latching means moveable between a first unlatched position when not in said make-up position to a second latching position when in said make-up position, whereby said coupling member is latchable to said coupling head of a respective tool in said make-up position.

Preferably, the spring-biased latching means of the coupling head on each of the tools comprises a plurality of circumferentially disposed pivotable collate fingers which are biased into a first unlatched position when uncoupled and are biased into a second latching position when said coupling member and said coupling head abut support means to allow the coupling member to connect to the coupling head of the respective selected tool.

Figure 1B:
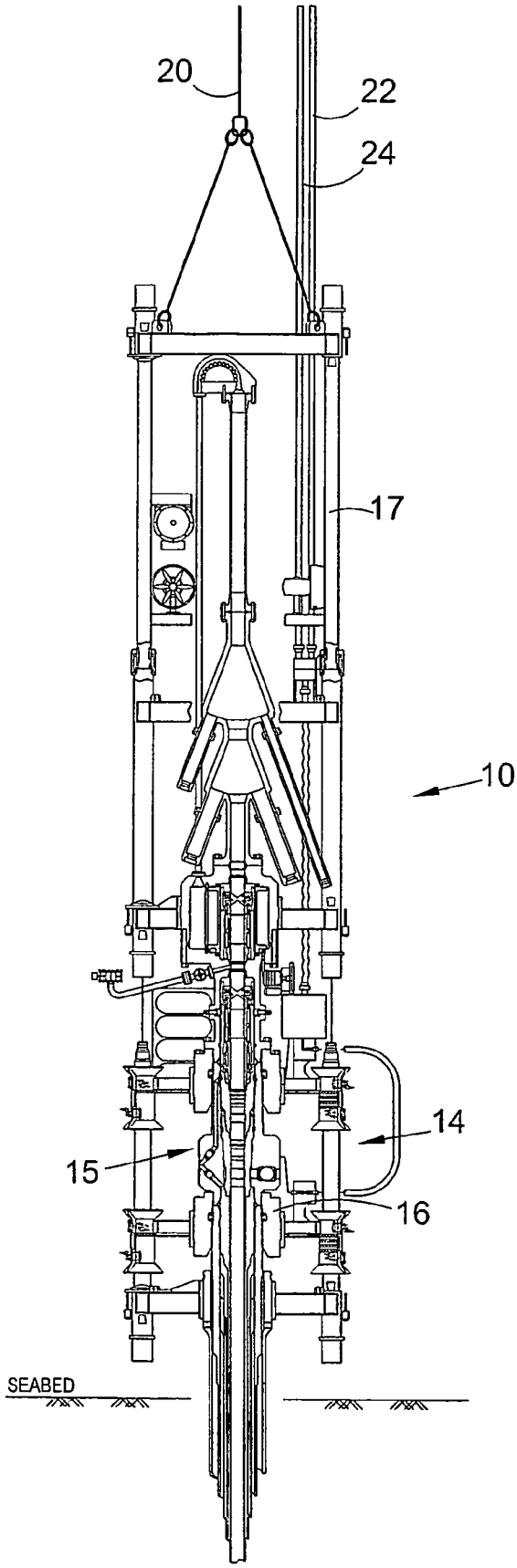
Figure 2A:
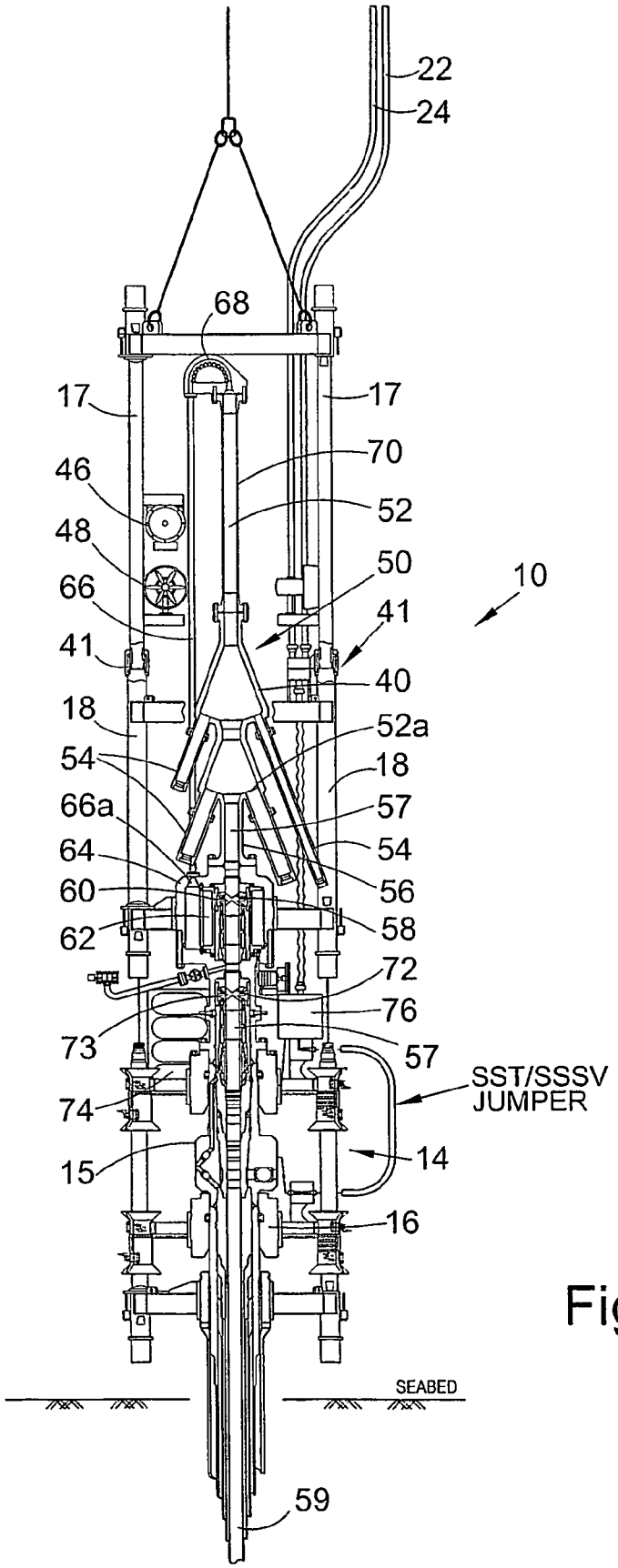

These and other aspects of the present invention will become apparent from the following description when taken in combination with the accompanying drawings in which:

FIGS. 1*a* and 1*b* depict a diagrammatic view of a complete autonomous well intervention system in accordance with a preferred embodiment of the invention shown coupled to a wellhead on the seabed;

FIG. 2*a* depicts an enlarged view of part of the deployed autonomous well intervention system shown in FIG. 2*a;*

Figure 2B:
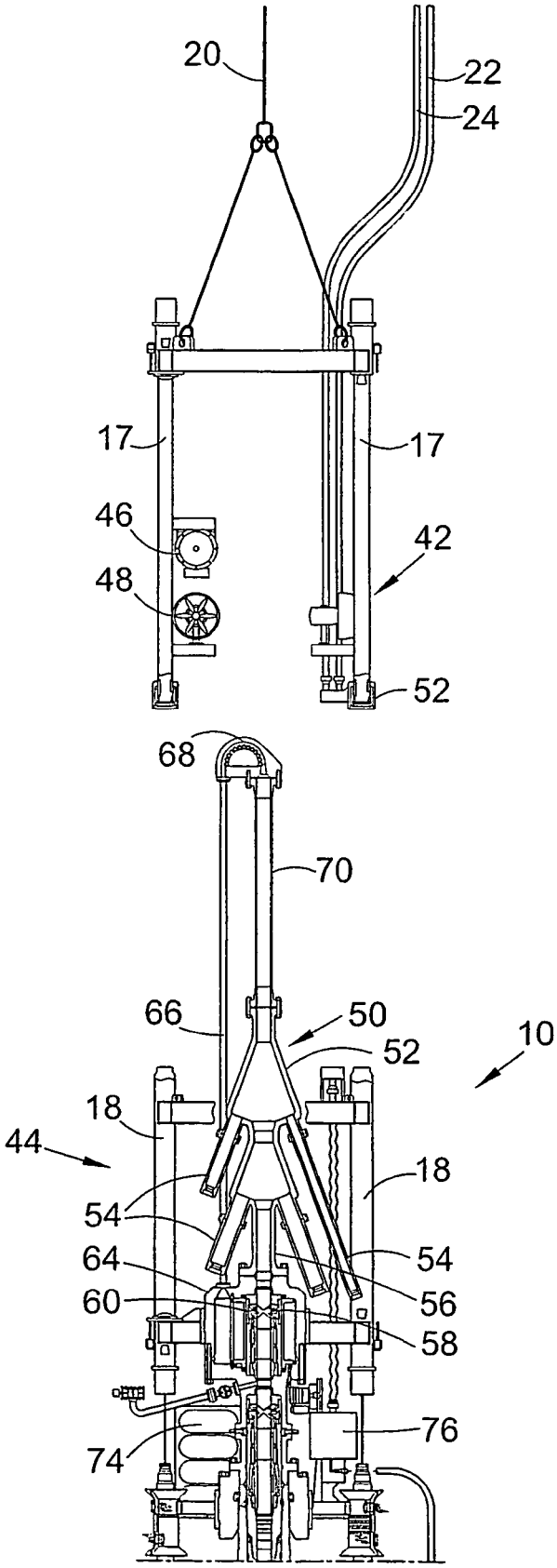
Figure 3A:
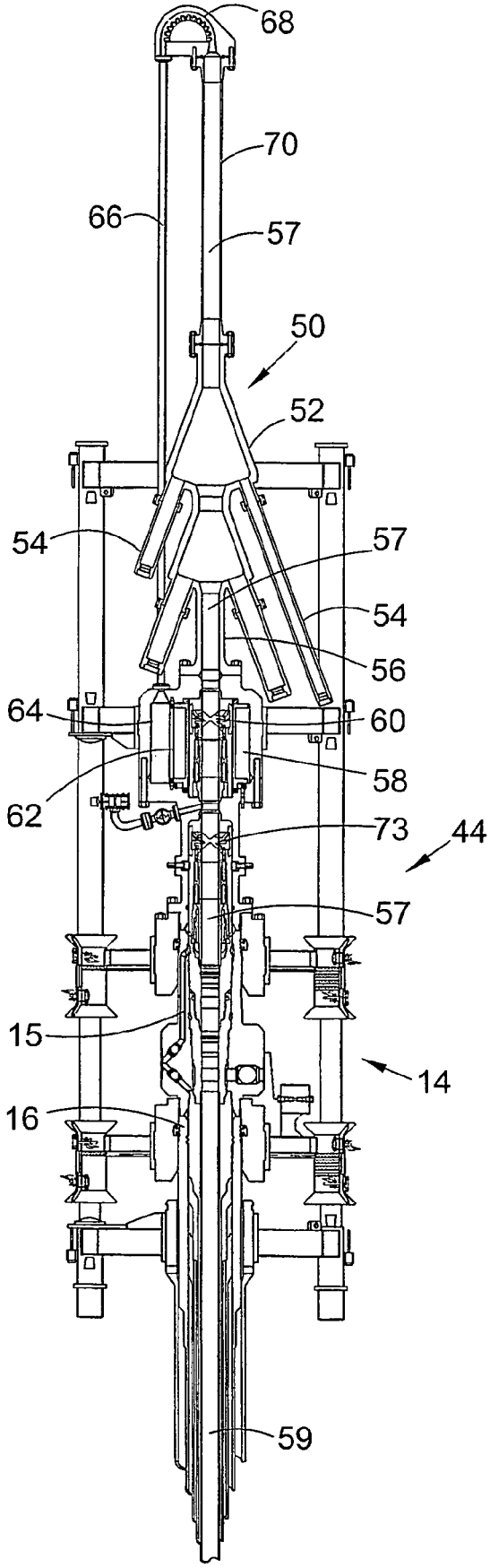
Figure 4A:
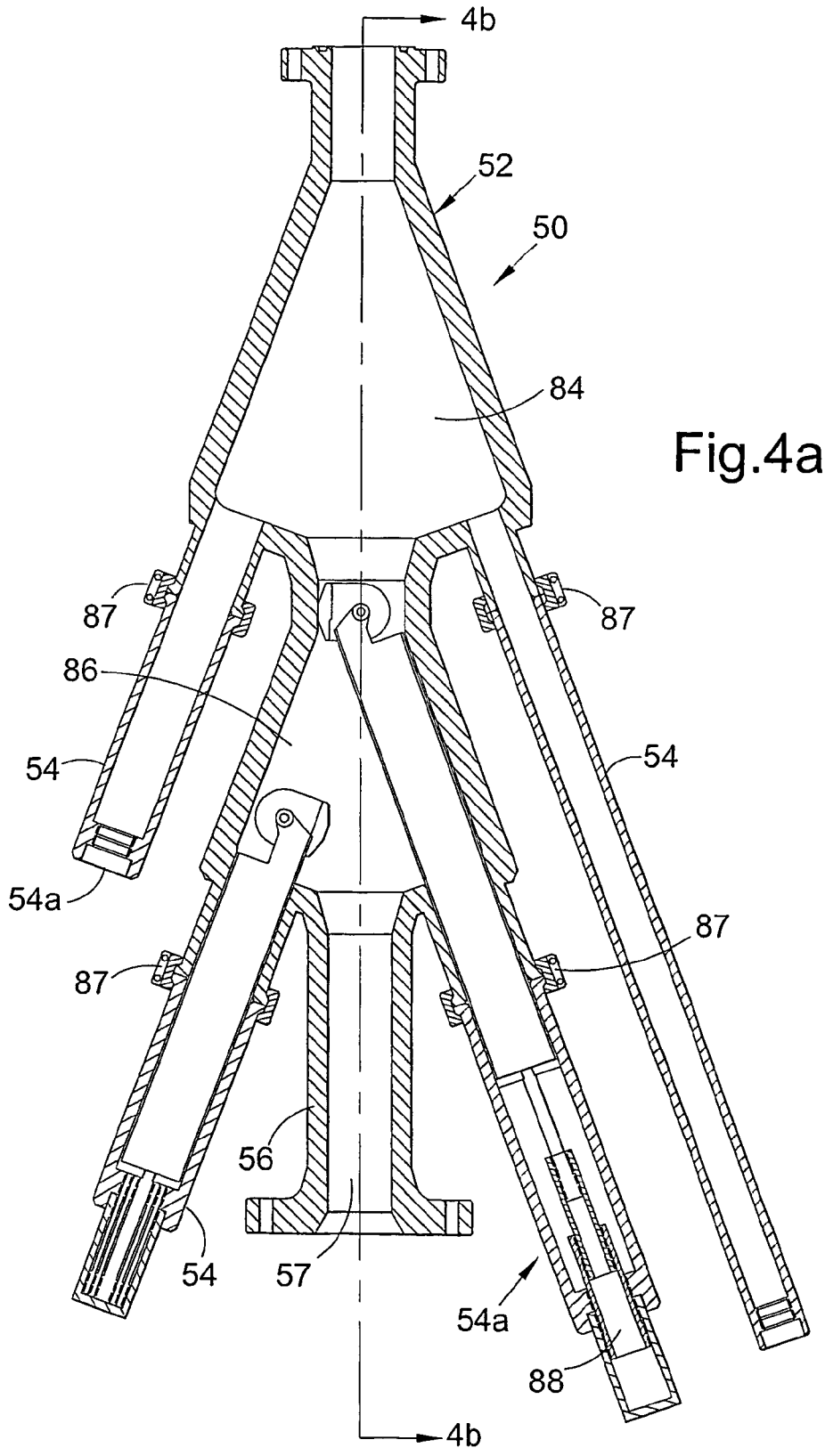
Figure 4B:
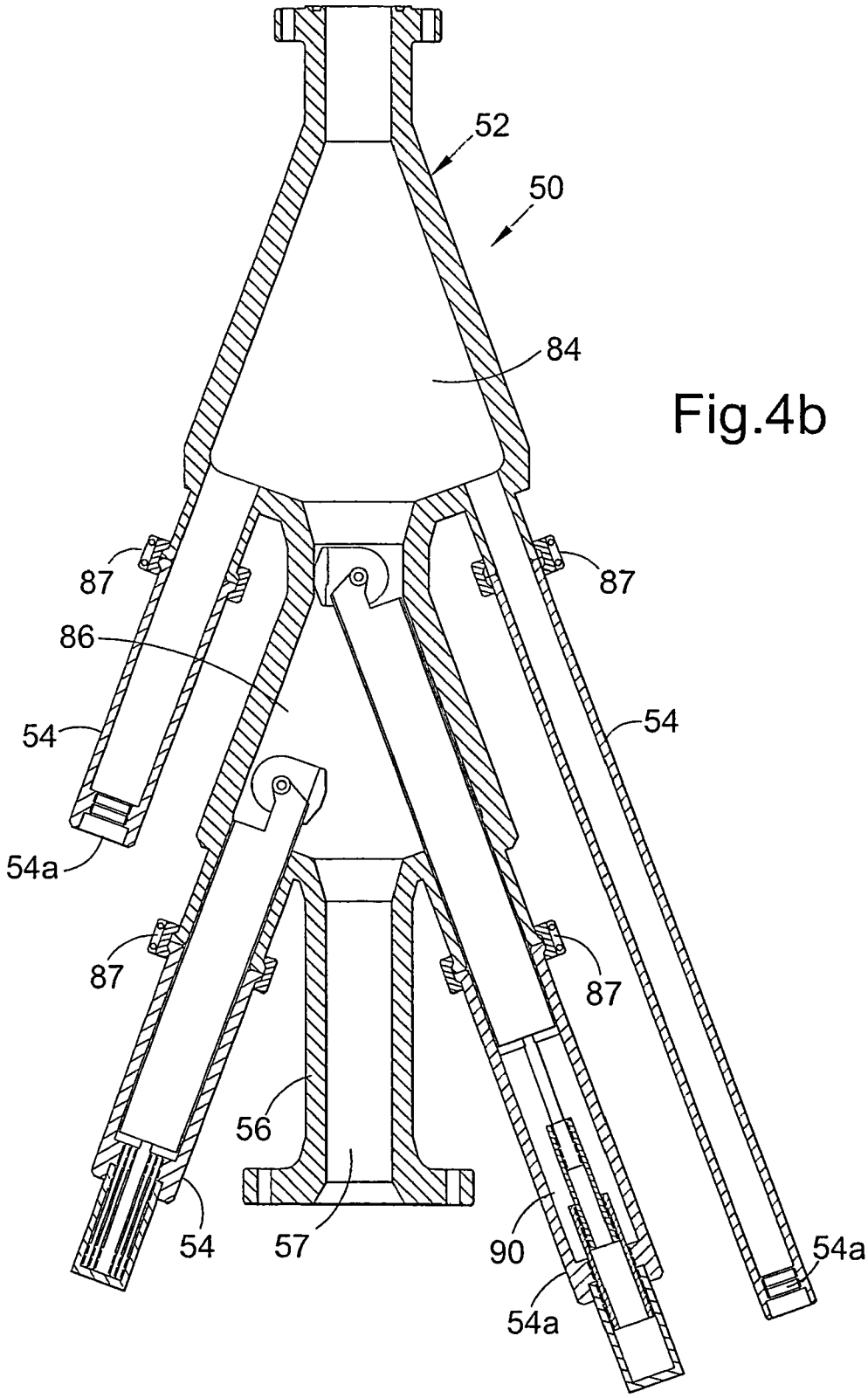

FIG. 2*b* shows the top part of the autonomous well intervention system carrying the intervention umbilical separate from the main part of the system;

FIG. 3*a* is a slightly enlarged view of the main part of the autonomous subsea intervention system shown in FIG. 2*a* but with standardised components omitted in the interests of clarity;

FIG. 3*b* shows the main part of the lightweight intervention system separate from a guide frame coupled to the wellhead;

FIG. 4*a* depicts an enlarged view of a longitudinal section through the tool magazine structure shown in FIGS. 1 to 3;

FIG. 4*b* is a similar view to FIG. 4*a* but taken on the lines 4*b*-4*b* of FIG. 4*a;*

Figure 4C:
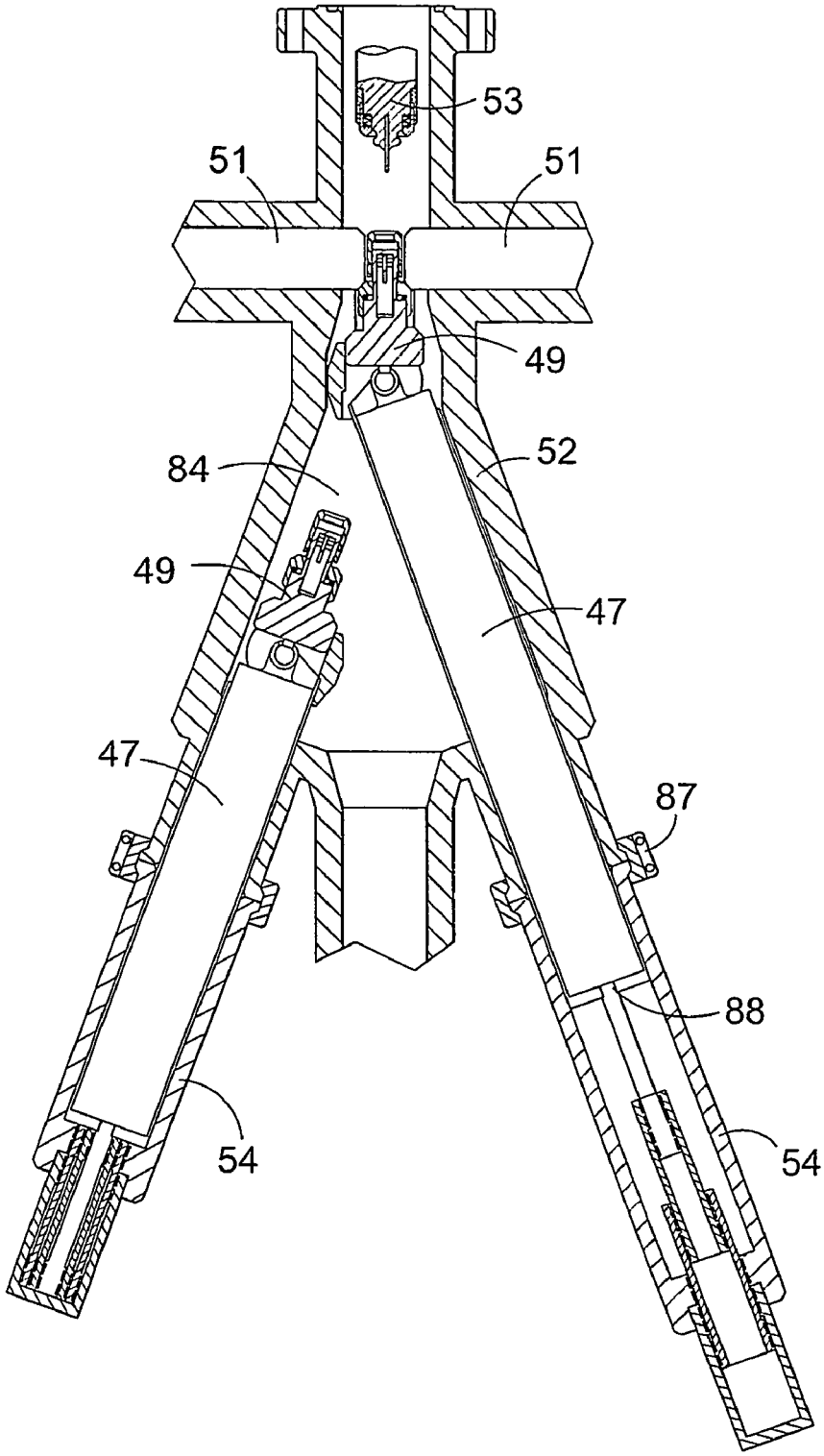
Figure 5A:
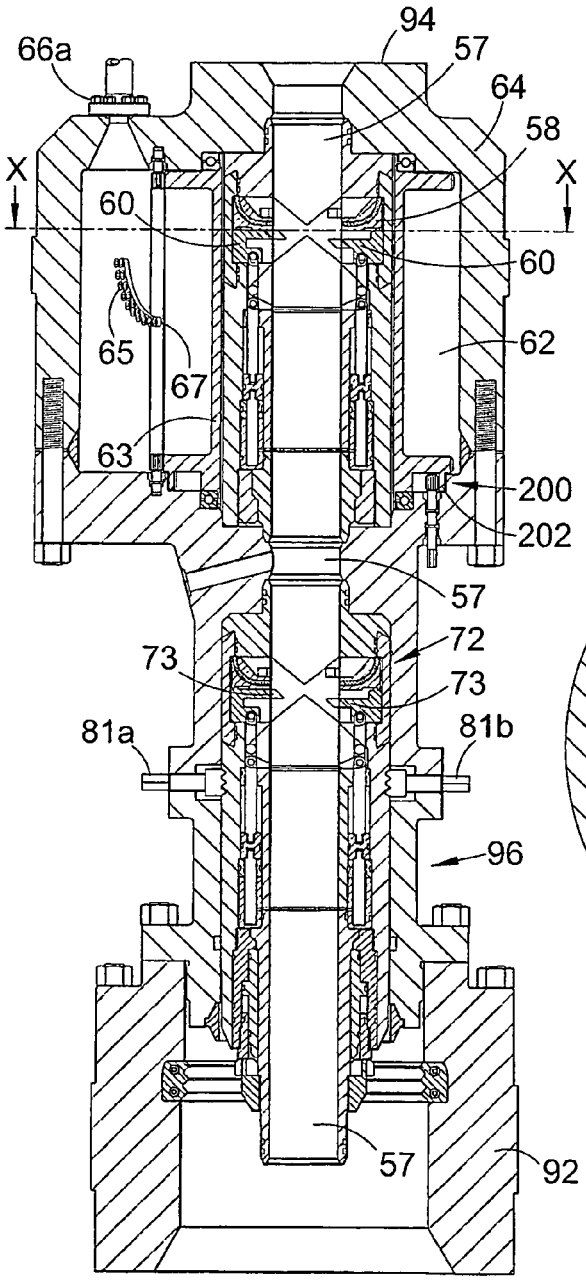
Figure 5B:
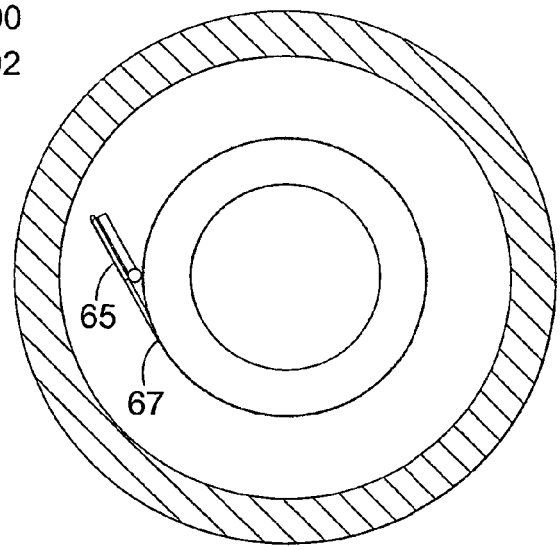

FIG. 4*c* shows a magazine housing similar to that shown in FIGS. 4*a* and 4*b* but with a tool in the process of being made-up in the magazine;

FIG. 5*a* is an enlarged view of part of the lightweight intervention apparatus surrounded by the broken outline of FIG. 3*b* and depicting a coaxially mounted winch and a barrier seal;

FIG. 5*b* is a cross-sectional view taken on the lines X-X of FIG. 5*a;*

Figure 7A:
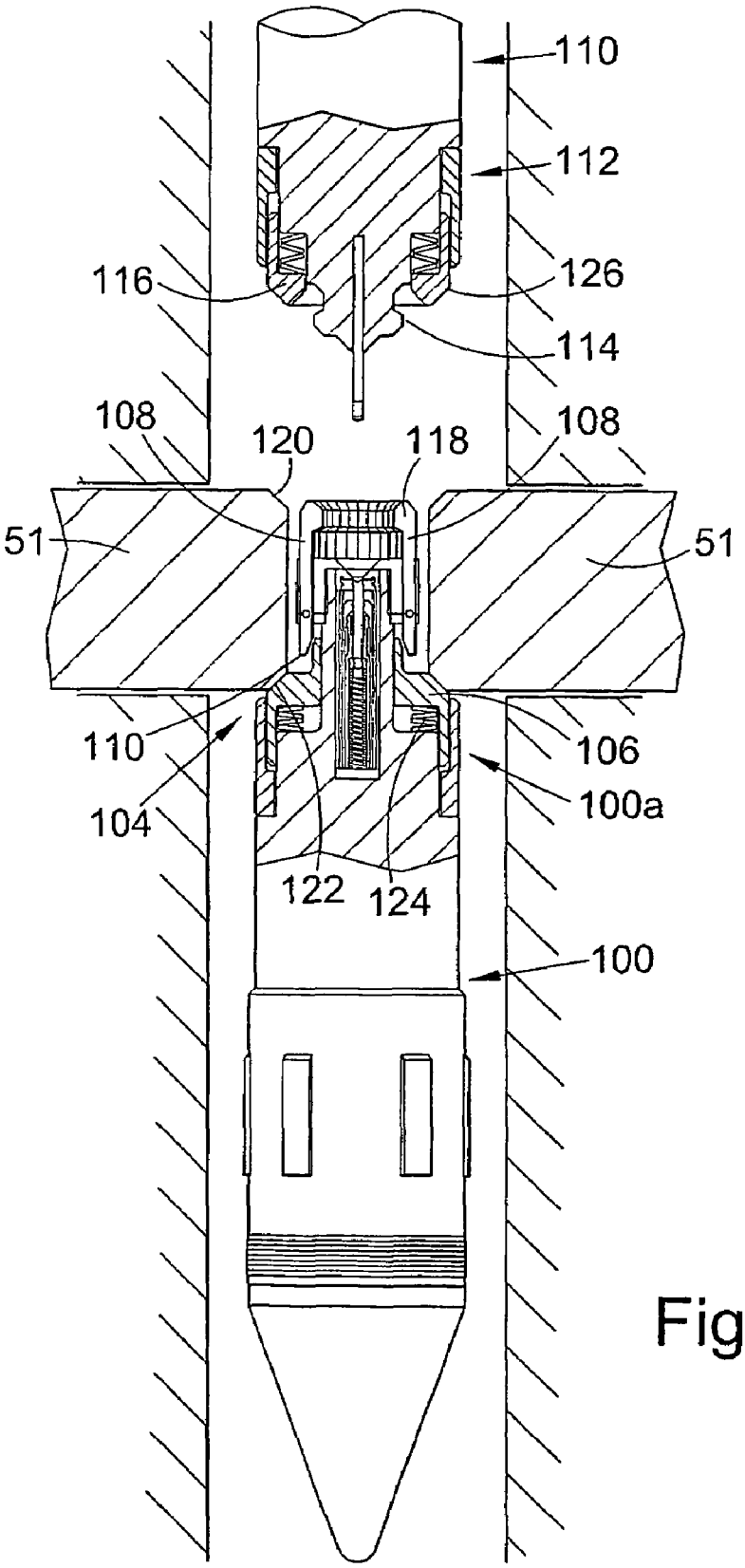
Figure 7B:
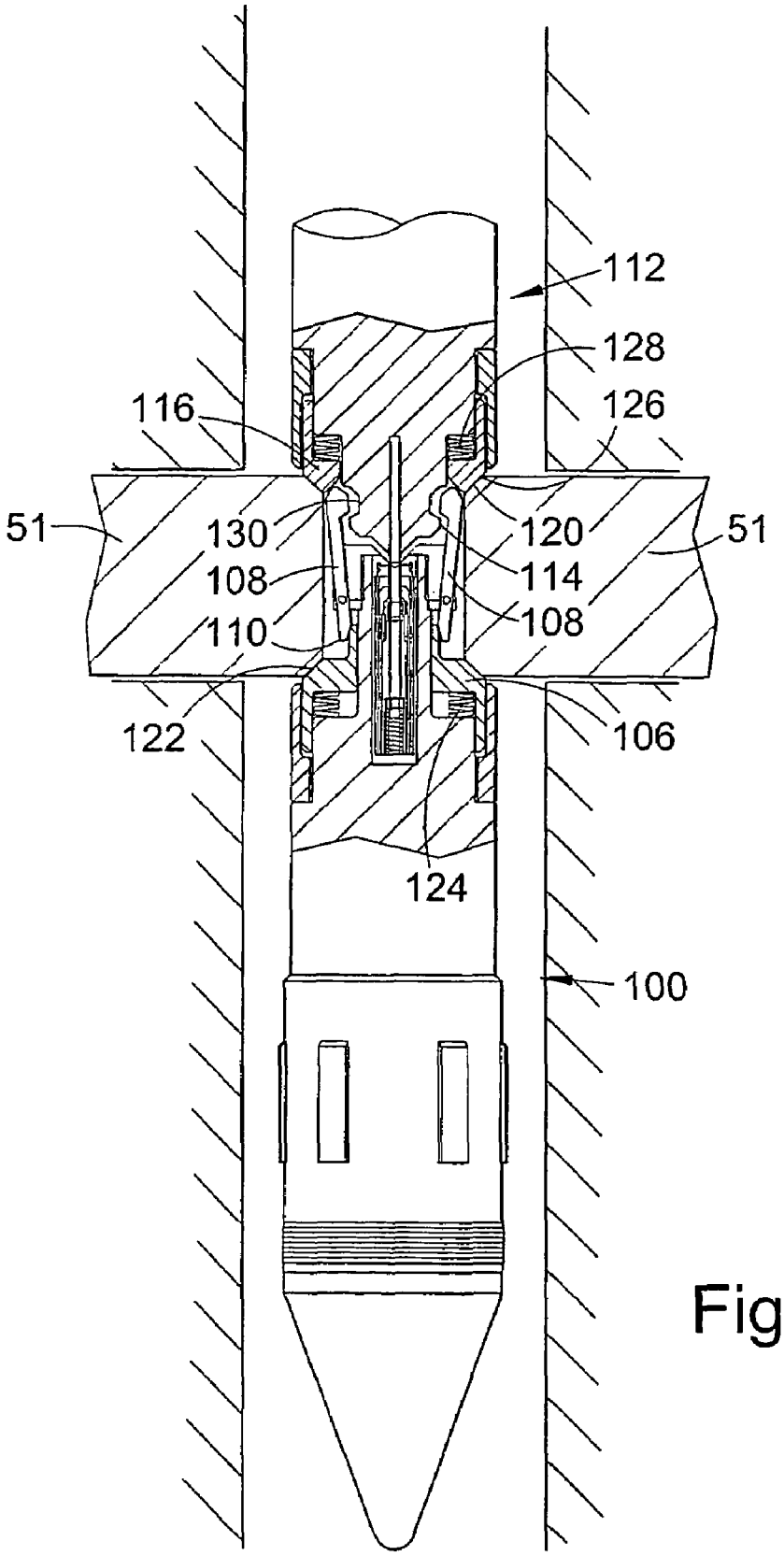
Figure 7C:
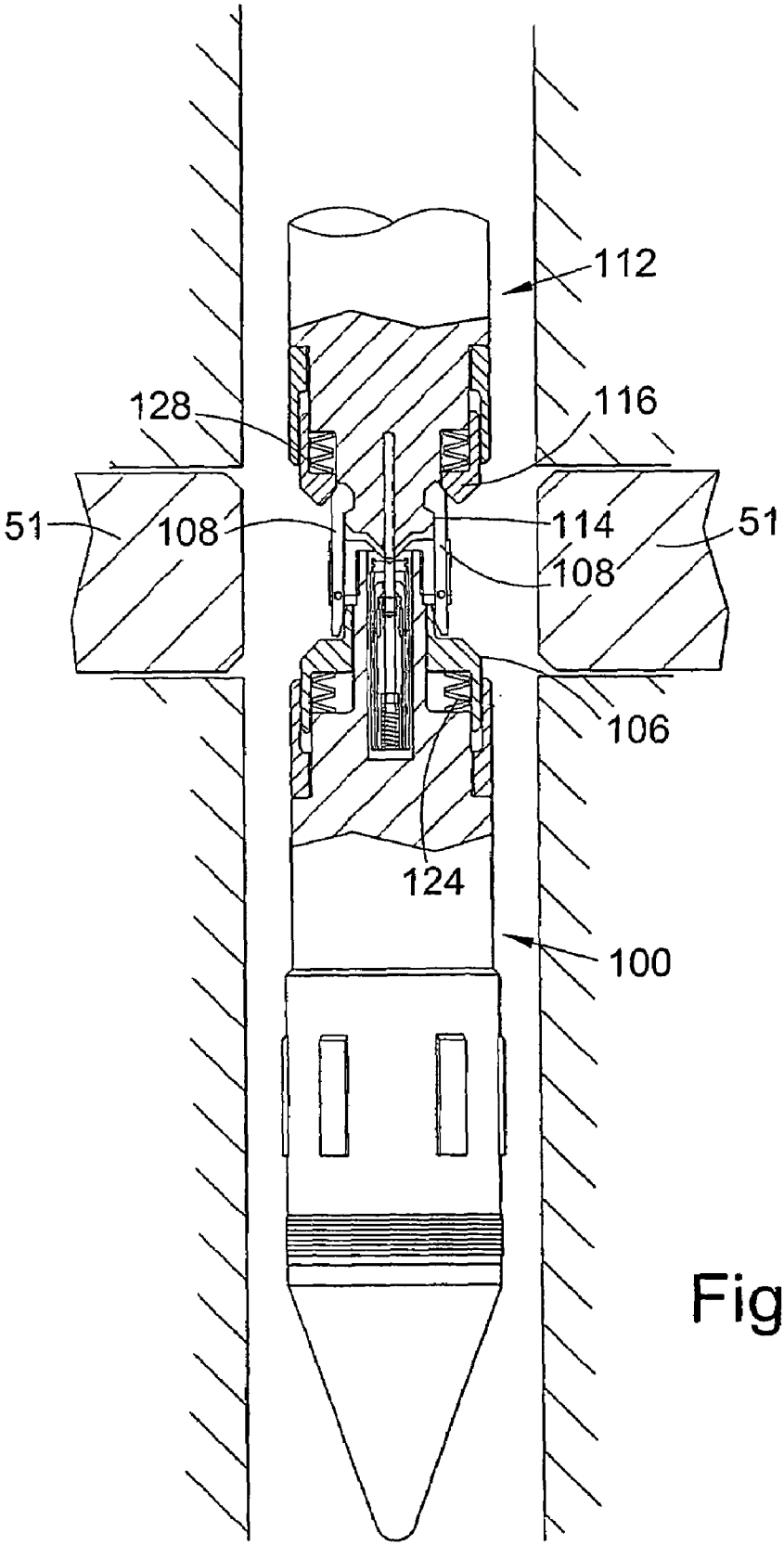

FIGS. 6*a*, 6*b*, 6*c* and 6*d* show sequential views of part of the SLWIS shown in FIG. 5*a* running in and being locked to the xmas tree to leave a barrier seal in place after SLWIS disconnection;

FIG. 7*a* is a diagrammatic view of part of the tool magazine housing showing a tool selected for deployment in a position for coupling to a tool coupling mechanism within the magazine housing;

FIG. 7*b* is similar to FIG. 7*a* and shows the tool coupling mechanism in position just before being coupled to the tool for deployment, and FIG. 7*c* is a view similar to FIGS. 7*a* and 7*b* but shows the tool coupling mechanism, coupled to the wireline tool after removable of the tool support rams.

Reference is first made to FIGS. 1*a* and 1*b* which depict a complete autonomous well intervention system in accordance with a preferred embodiment of the present invention. The system has a deployable marine portion, generally indicated by reference numeral 10, which mates with a guide frame 14 containing an xmas tree 15 mounted on top of the wellhead 16 on the seabed. The marine portion 10 has a support frame, generally indicated by reference numeral 17, which is suspended from a vessel (not shown) by a deployment cable 20. This supports umbilicals 22,24 coupled to the system 10 for providing power and control functions from the surface. This is best seen in FIG. 1*a* where SST/SSSV (Subsea Tree/Subsea Safety Valve) umbilical 22 is fed from umbilical reel 26 which is, in turn, coupled to a SST high pressure unit and control panel 28 which receives vessel air and power via inlets 29*a*,29*b* supported (the vessel is not shown in the interests of clarity). Intervention umbilical 24 is fed from umbilical reel 30 which, in turn, is coupled to a Master Control Unit (MCU) and control panel 32 which is, in turn, coupled to a chemical injection unit 34 and intervention HPU (Hydraulic Power Unit) 36 which is fed by vessel air and power via inlets 35*a*,35*b*. The intervention system and components are manufactured using well-known materials which have subsea applications such as Inconel alloys and steels.

The lightweight intervention system consisting of the unit 10 and 14 is deployed by cable 20 from a lightweight intervention vessel. The weight of the intervention system to be deployed is around 35-40 tonnes and would be deployed from a vessel with as little as 2000 tonnes displacement, e.g. Ustein 12000 class, DNV classified using an A-frame crane which raises and lowers the intervention system over the rear of the vessel. It will be appreciated that this has hitherto been impossible on vessels of this size which has given rise to the problems referred to in the background to the invention and the prior art.

The intervention system is shown in more detail in FIGS. 2*a* and 2*b*. It will be seen that the intervention system 10 is made up of several components. All of the components are located within the frame 17 which is essentially box frame which contains the autonomous well intervention system which is disposed within the box frame. The box frame can be separated at various points as shown in FIG. 2*b*, for example, and which will be described in detail later. Referring to FIG. 2*a*, it will be seen that the SST and intervention umbilicals 22,24 are coupled to an umbilical QDP 40 (quick disconnect package) which is adjacent to a latch interface 41 (one of four such interfaces) which the upper frame part 42 is coupled to a central frame part 44. FIG. 2*b* shows the two frame parts 42,44 separated which may be necessary in the event of adverse weather conditions, thus leaving the main part 44 of intervention system coupled to the xmas tree 15, as will be later described in detail. The upper frame structure 42 includes motor/pumps 46 and four thrusters 48 (one of which is shown) which assists in maneuvering the intervention system onto the wellhead.

Within the main intervention frame part 44 is the actual intervention hardware or apparatus. This is best seen in its entirety in FIG. 2*a*. It comprises a tool magazine, generally indicated by reference numeral 50, having a tool magazine housing 52 which has coupled to it a plurality of magazine pockets 54 which are disposed radially around the tool magazine housing 52 and which are inclined downwardly as shown. Each of the magazine pockets, or pods 54, is designed to contain a deployable intervention tool which can be retrieved from the respective pocket and made up into an intervention string for running a well intervention, as will be later described in detail. In the interests of clarity, the pockets 54 are shown empty. The base of the magazine housing 52*a* terminates in a wellbore portion 56 which is coupled to the top of a BOP barrier seal unit 58. Barrier seal unit 58 contains a well barrier in the form of actuatable shear rams 60. As will be later explained, these rams 60 can also be controlled to provide a support for intervention tools so that the tool string can be made up within the wellbore.

Surrounding the rams 60 is a vertically disposed rotatable drum or winch 62 contained in a winch housing 64. A slickline is fed from the winch through the housing 64 to a narrow bore vertical lubricator section 66 which is connected to an upper sheave 68 which, in turn, is coupled to a large bore lubricator tube 70 which has the lower portion 66*a* coupled to the top of winch housing 64. As will be later explained, the slickline or electric line is coupled to the intervention tool coupling medium or tool adaptor head (see FIGS. 6*a*-6*c*) which couples to tools from respective magazine pockets positioner for deployment. The picked up tools can be hung off the partially closed rams 60, while the adaptor head is released from a tool and used to pick up further intervention tools and join these to form a concatenated tool intervention string.

The intervention string defines a throughbore 57 which passes through the winch 62 all the way to the wellbore 59. Well barrier section 72 contains a further BOP or set of shear rams 73 for shearing the tool string in the event of an emergency and for allowing the well to be sealed and the intervention system retrieved to surface. Surrounding the barrier section 72 are control accumulators 74 and a subsea control module 76. The control module 76 is a dual hydraulic, single electronic system and can switch from one control fluid to the other without the necessity of flushing the system. There are separate sides of the control valve manifold (not shown), one side being fed with water-based fluid and the other with mineral oil. The appropriate fluid for the applicable tree being worked over is selected at the surface prior to starting the intervention and this automatically sets the hydraulic power unit and Riser Control Module to use the appropriate fluid. Accumulators 74 are used to obtain adequate response times. The lower part of frame 44 is coupled to the top of the horizontal xmas tree 15 which is disposed in a lower guideframe 14 and the tree 15 is shown coupled to top of the wellhead 16. The preferred workover control system for multi-field operations is an electro-hydraulic multiplexed system using independent hydraulic circuitry and valves for control of the production equipment. This allows intervention on trees using both water-based and mineral oil control fluid without changing or flushing the pods 74, umbilical or hydraulic power unit.

Reference is now made to FIGS. 3*a* and 3*b* which depict a slightly enlarged version of the autonomous well intervention system shown in FIG. 2*a* but without the top guide package and thrusters and some other parts are omitted in the interests of clarity, such as the subsea control module and control accumulators. FIG. 3*b* shows the actual well intervention unit to be deployed on top of the horizontal tree guide frame 14. Like units refer to like parts in the previous drawings and it will be seen that within the intervention apparatus, the main bore 57 has two barriers in place, on provided by the lower BOP 72 and one by the upper BOP 58, each of which is independently actuatable which will be later described in detail with reference to FIG. 5*a*.

Reference is now made to FIGS. 4*a* and 4*b* of the drawings which depict, to a larger scale, the tool magazine 50 shown in FIGS. 1 to 3 with tool make-up rams omitted in the interest of clarity (see FIG. 4*c*). As mentioned before the tool magazine consists of a magazine housing 52 which has upper atrium section 84, a lower atrium section 86 and lower bore section 56, which is coupled to the atrium section 86. FIG. 4*b* is a sectional view taken on the lines 4*b*-4*b* of FIG. 4*a*. It will be seen that there are eighteen pockets or pods 54 (six at 7⅜" id; six at 6" id and six at 4" id) shown coupled to the upper and lower atrium housings 84,86. It will be seen that each of the pockets is coupled via a flange 87, thus allowing a pocket to be removed and replaced by a blank plate or by another pocket containing a particular tool to be deployed for example using an ROV. In the interests of clarity, the tools have been omitted in the pocket interiors. The pockets are inclined at about 20 degrees to the wellbore axis and are open to well effluent.

At the foot 54*a* of each pocket is disposed a hydraulically actuatable ram, generally indicated by reference numeral 90, which is best seen in the magazine pocket identified as 54*a* in FIGS. 4*a* and 4*b*. The hydraulically actuated ram 90 is controlled from surface and energised to push the tool located therein from the pocket into atrium 84 in this particular case. As will be later described, the leading portion of the intervention tool has a coupling head which is coupled to an adapter head which then allows the tool to be extracted using the winch 64 within the magazine housing 52, drawn up inside the lubricator section 70 for subsequent deployment through the intervention system through bore 57. The length of the lubricator section 70 depends on the anticipated length of the intervention string to be made up. The shape of the magazine housing atriums 84 and 86 permits tools to be retrieved from the pockets into the magazine housing before subsequent deployment through the intervention wellbore.

Reference is now made to FIG. 4*c* of the drawings where a tool 47 is shown being made up in magazine housing atrium 84. In this case the tool 47 has been pushed by ram 88 into the position shown and the tool coupling head 49 is shown abutting rams 51 which places the tool coupling head in a position to receive a tool adaptor head 53 to couple the tool to the wireline and create an intervention string. The make-up will be discussed in detail with reference to FIGS. 7*a*, 7*b* and 7*c*.

Reference is now made to FIGS. 5*a* and 5*b* which depict the section 5*a* in broken outline in FIG. 3*b* in greater detail and shows the winch 62, pressurised housing 64, upper rams 60 and lower BOP 73. In addition, also shown is the lower wellhead connector 92 which fits on top of the wellhead portion of the horizontal xmas tree section 15.

In FIG. 5*a* it will be appreciated that the rotatable winch 62 is vertically oriented such that it is coaxial with the bore section 56 and wellbore 57. The drum 62 is mounted on an axis parallel to the wellbore 57. The inner sleeve 63 of the drum form a non-pressure containing wall from the wellbore 57. The drum drive system is via a tapered gear profile (not shown) located on the lower flange 200 of the drum which is engaged by a pinion gear 202, the shaft of which penetrates the lower face of the winch forging. The shaft is sealed by an arrangement of high integrity V type packings. This enables both the drum drive and braking systems to be located externally to the well and therefore the drive to be performed by the ROV or an independent system replaced by the ROV, substantially increasing system availability.

The parallel mounting of the drum enables it to be housed in a standard forging which is simple to manufacture, relatively lightweight and being located concentric to the well axis requires no counter-balancing. With a vertically mounted drum arrangement the spooling is considerably different to that found in normal systems because the wire has to make two direction changes as it leaves the drum unlike the single direction change found in normal systems. This is achieved by mounting a Lebus screw parallel to the drum, which is driven off the o/d of the drum flange. Attached to the Lebus screw is a compliantly mounted set of bearings 65 through which the wire passes allowing the wire to change from the horizontal to the vertical direction. This means that the winch cable or slickline 65 leaves through a single common aperture 67 in the winch housing 64. This means that the horizontal (unspooling) movement of the winch line (see FIG. 5*b*) is translated to a vertical movement as best seen in FIG. 5*a* and the winch line is then fed through small bore (2") lubricator 66*a*. The compliant mounting of the bearings enables the different entry angles of the wire generated by the number of wraps on the drum to be accommodated.

The wire leaves the drum housing by a tapered orifice 66*a* in the upper flange terminated by a 2" hub. The slickline is fed via orifice 66*a* through lubricator section 66 over a pressurised housing containing sheave wheel 68 as shown in FIG. 2*a* and back through the upper widebore (7.5") lubricator section 70 which couples to the top of the magazine housing 50, again as best seen in FIG. 2*a*. The use of two independent or separate sections; one for passage of the tool string and one for passage of the wire, offers considerable weight saving, substantially reduced environmentally induced loadings and enables the lubricator sections to be made from a conventional design connected by metal-to-metal seal tapered hubs providing excellent pressure and structural integrity.

The lower bore 56 of the magazine housing couples to the top 94 of the housing 64 so that the intervention tool bore 57 is aligned to allow the intervention string to be run. It will be seen from FIG. 5*a* that the BOP 58 is mounted in the bore within the drum 62. The BOP 58 has shear rams 60 and the function of the BOP is two-fold: firstly, as will be later described, rams 60 are actuatable to move between an open and a partially closed position so as to provide a means for gripping a tool string in place and facilitate tool string assembly and disassembly in wellbore 57 allowing the deployment of relatively long tool strings; and secondly, the upper BOP 58 provides an additional well barrier in the event of loss of pressure integrity of the upper system.

The winch housing 64 is coupled to a lower unit 96 which contains a further blind shear 7⅜ BOP 72 with shear rams 73. The BOP 72 provides secondary well isolation during intervention operations and if required to remain in place on the wellhead after actuation of ROV dogs 81*a*,81*b*, as will be later described. In this situation the integral BOP 72 provides the primary well barrier until installation of the drilling BOP at which time it would be retrieved. The lower unit 96 terminates in the 18¾" wellhead connector 92 which fits onto the top of the horizontal tree 15.

BOPs 58 and 72 are proprietary to Norsk Hydro AB and identical in structure and in operation. Accordingly, only BOP 58 will be described in detail although it will be understood BOP 72 has like parts with suffix 'a' and operated in a like manner.

BOP 58 has a single operating piston 200 located in the vertical axis parallel to bore 57. The piston 200 is hydraulically operable and the force and movement generated by the piston are transmitted to shear rams 60 by two means 202,204 articulated at the piston end 207 ad ram end 209 and 210 which allow the vertical movement of the piston 200 to be translated into horizontal movement of the rams 60. The operating piston is pressure balanced providing failsafe actuation.

The blade faces 206,208 of rams 60 interlock using the void area of the outside diameter of the bore 57 and the face of the ram in the closed position which reduces the length of the ram required to remain in the ram pocket providing vertical restraint against differential pressure induced loading.

The blades 206,208 are vertically restrained to the ram body but are free to bend on the horizontal axis by about 1.5" (4 cm) in relation to the rams. The blade sections 206,208 are attached to respective beams 202,204 so that initial movement of the beam extends the blade passed the sealing face by about 1.5" (4 cm) prior to any movement of the rams 60. Once the blades are extended the ram 60 begins movement to ensure that any cutting operation is completed before the ram sealing faces contact the intervention string. The extended blades 206,208 also interlock into the opposite ram providing additional support and rigidly resisted differential loading.

The rams 60 are blind/shear rams which can shear wireline and the tool string or a combination of both to achieve a bubble tight seal. The shear inserts are designed to cut a pre-specified size of string and can be changed to accommodate different sizes of string.

Figure 6A:
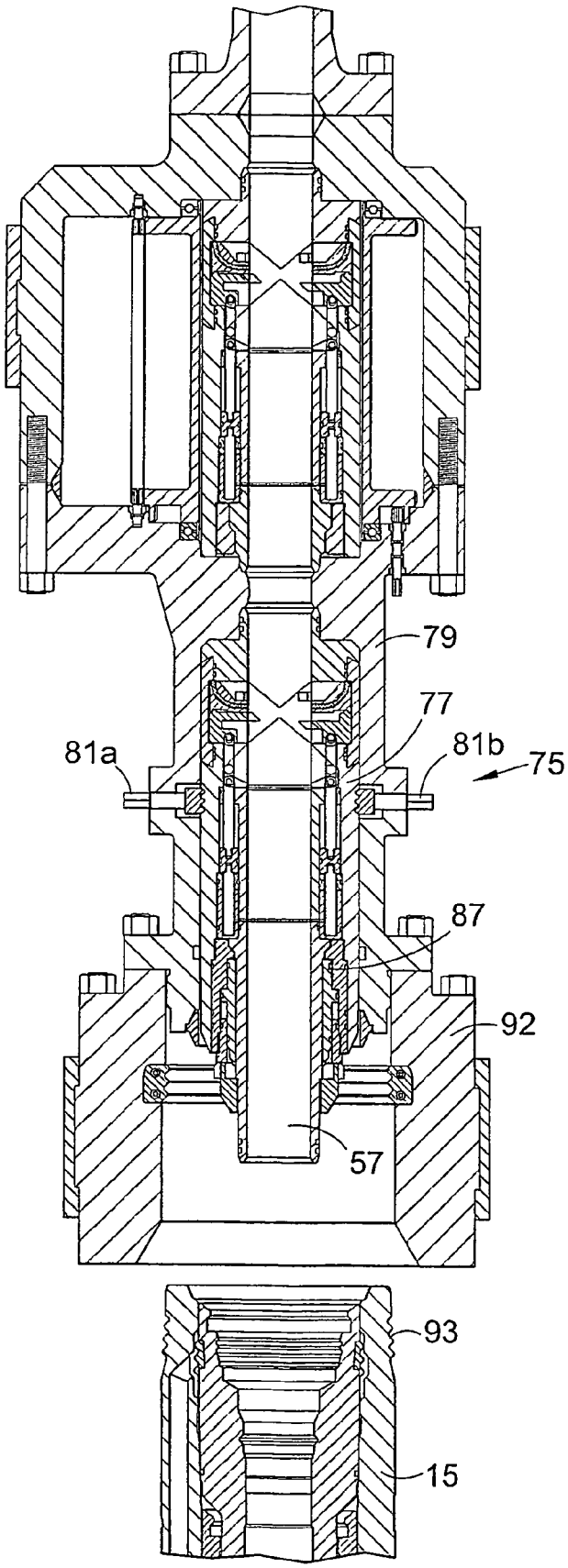
Figure 6B:
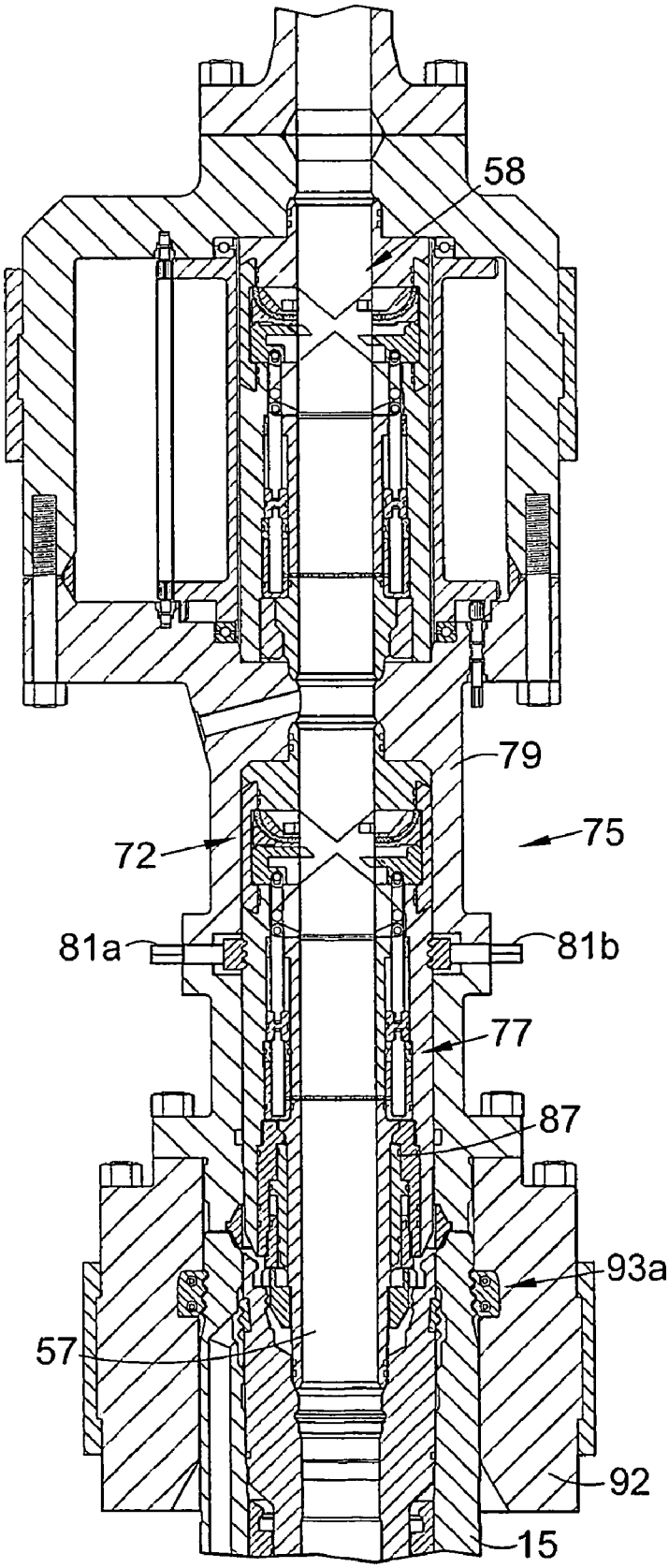

Reference is now made to FIGS. 6*a,b,c* and *d* of the drawings which are similar to FIG. 5*a* which depict how the subsea lightweight well intervention system (SLWIS) is coupled to the xmas tree wellhead 15 by connector 92. The lower part of the section 5*a* contains a valve sub-assembly, generally indicated by reference numeral 75, containing a detachable valve unit 77, best seen in FIG. 6*d*. During SLWIS run-in as shown in FIG. 6*a* the valve unit 77 is locked into an outer housing 79 by dogs, 81*a*,81*b*. At the lower end of the valve unit 77 a hydraulically operable sleeve 87 is disposed therein which is axially moveable between a locked and an unlocked position, as will be described. In the position shown in FIG. 6*a* the sleeve is operably disposed in valve unit 77 and in this condition the lower connection is unlocked.

When the SLWIS is landed in the xmas tree wellhead coupling portion (FIG. 6*b*), this is the normal operating mode. The wellhead connector 92 mates with the external grooves 93 of the wellhead portion at the top of the xmas tree to form coupling 93*a* as shown. The upper dogs 81*a*,81*b* are still locked and the lower sleeve 87 is unlocked. In this condition two BOP barrier seals 58,72 are actuatable to seal the throughbore 57. The valve unit 77 remains locked to the outer housing 79 in this normal operating mode.

Figure 6C:
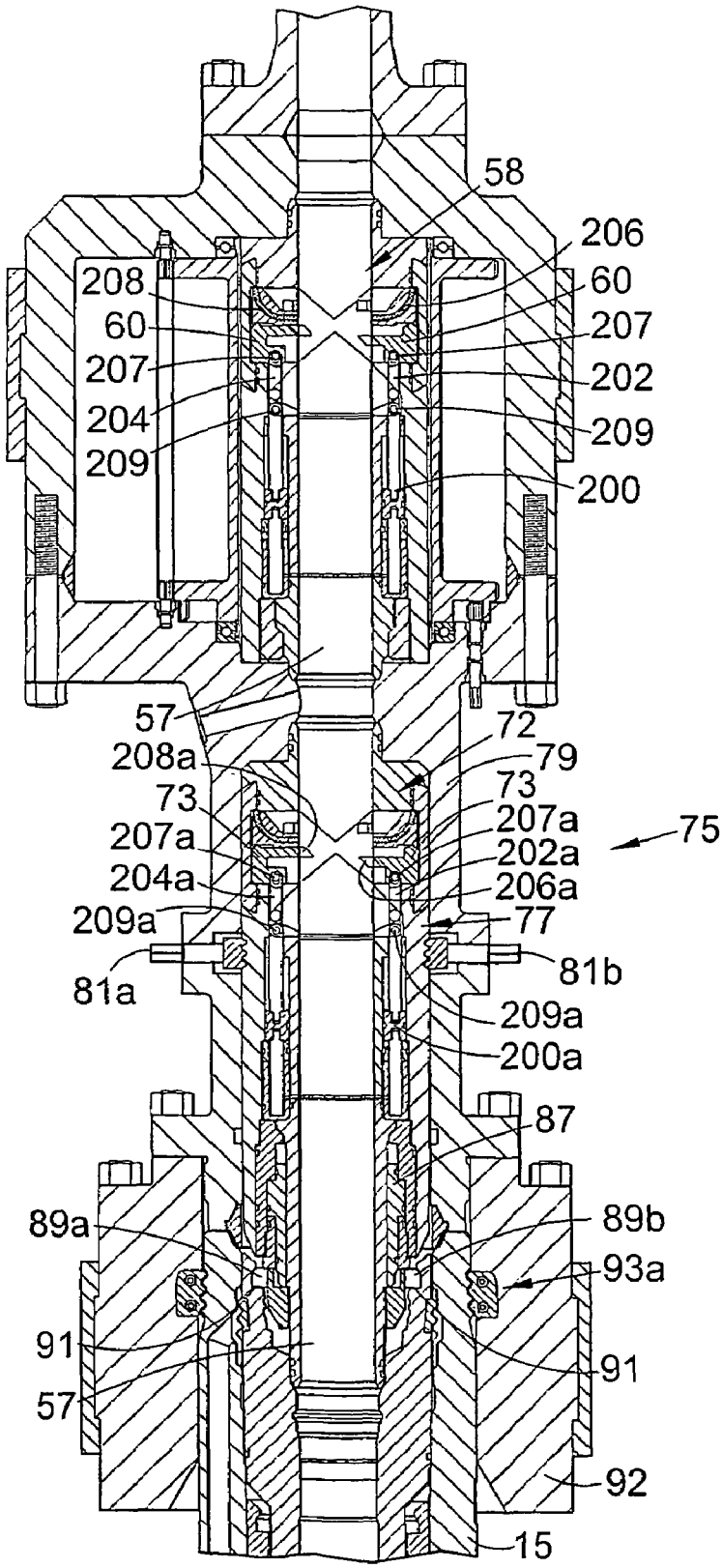
Figure 6D:
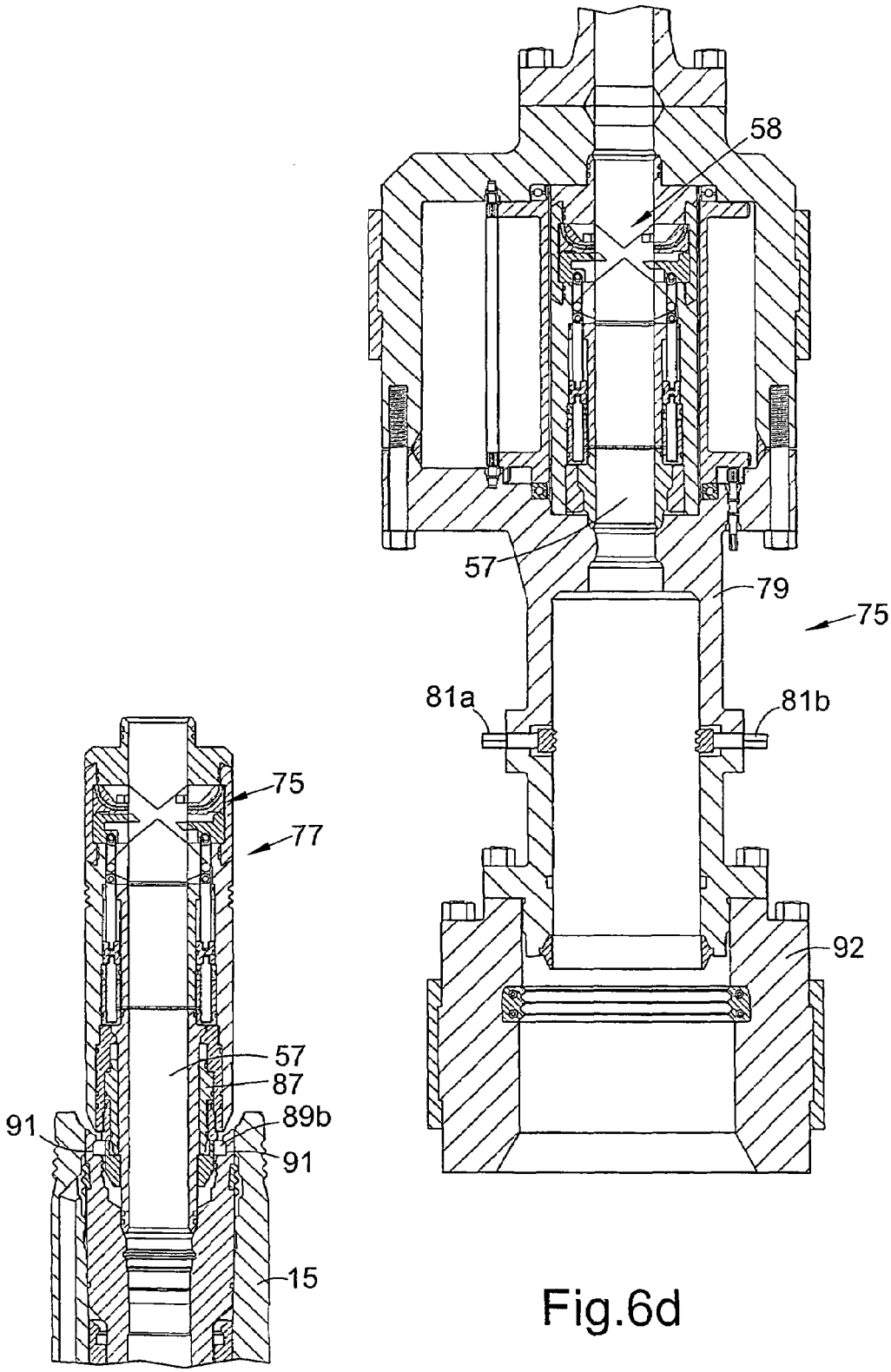

In the event that the SLWIS requires to be retrieved whilst leaving the valve unit 77 in replace, then the valve unit 77 is unlocked from the housing 79 and locked to the xmas tree wellhead portion denoted as the xmas tree wellhead 15. As best seen in FIG. 6*c*, this is achieved by first actuating well barrier 72 using shear rams 73 and then unlocking dogs 81*a*,81*b* from engaging valve unit 77 using an ROV and by energising the hydraulically operable sleeve or mandrel 87 downwardly which causes dogs 89*a*,89*b* to engage in internal groove 91 at the upper end of the xmas tree wellhead 15. Thus when the dogs 81,81*b* are unlocked and dogs 89*a*,89*b* locked in groove 91, the entire SLWIS can be withdrawn from the xmas tree wellhead 15 and retrieved to surface leaving the valve unit 77 in place as shown in FIG. 6*d* with the BOP 72 providing the primary well barrier. The valve can also be locked to the tubing hanger via the tubing hanger running tool (THRT) interface (not shown in the interests of clarity). The diameter of the valve unit 77 is such that a conventional BOP can be run over the unit 77 and located on the outside of xmas tree wellhead 15 if required to provide a secondary well barrier.

Reference is now made to FIGS. 7*a*, 7*b* and 7*c* of the drawings which depict how a selected tool is coupled to a tool adaptor unit for being made up into an intervention string in magazine atrium 84 and then run through the intervention bore 57 into the well 59 for conducting an intervention operation.

As explained above, each of the pods or pockets 54 is designed to house an individual intervention tool. Each pocket 54 is provided with an integral hydraulic ram 88 to deliver the upper end of the tool to a make-up/break-up position in the magazine housing atrium 84.

In FIG. 7*a*, an intervention tool 100 is shown abutting rams 51. The upper end 100*a* of the tool has a latching structure, generally indicated by reference numeral 104. The latching structure 104 has a spring-loaded sleeve 106 and includes a plurality of upward facing collet fingers 108 which are inwardly biased and tend towards a closed position. The axially spring-loaded sleeve 106 engages the lower inner face 110 of the fingers 108 to ensure that the fingers 108 are supported normally in the closed position as shown.

The lower end of the wireline 66 terminates in an adaptor head 112 which includes a mandrel profile 114 onto which the collet fingers 108 are to be engaged. A further axially spring-loaded support sleeve 116 is provided on the adaptor head 112 which engages onto the upper outer face 118 of the collet fingers to ensure again that the fingers 108 are supported in the enclosed condition.

As described above, the rams 51 are disposed in the main body 52 of the tool magazine 50 and these rams 102 have upper and lower profiles 120,122 to offer upward and downward circular shoulders when energised to the closed position as shown in FIG. 7*a*. In the position in FIG. 7*a*, the tool 100 has been urged upwardly by the ram from the respective magazine pocket and the spring-loaded sleeve 106 abuts the lower circular shoulder 122 of the rams, thereby compressing springs 124 as shown. Further extension of the pocket ram causes the tool 100 to continue to travel upwards but the support sleeve 106 remains static as it abuts the circular face 122 of the ram. As the support sleeve spring 124 is compressed, the collet fingers 108 are now free to expand, as shown in FIG. 7*b*. The adaptor head 122 is then delivered downwards until the lower face 126 of the adaptor head support sleeve 116 contacts the mating face 120 of the support rams 51, as best seen in FIGS. 7*b*. Continued downward movement of the adaptor head 112 causes the support sleeve spring 128 to compress and further movement causes the adaptor head mandrel 114 to contact the collet fingers 108 which expand over the mandrel shoulder and engage into the groove 130, again as best seen in FIG. 7*b*.

As best seen in FIG. 7*c*, the rams 51 are then retracted to allow the support sleeve springs 124,128 to expand and force the support sleeve 116 to engage onto the collet fingers 108 under the action of the spring 128. This arrangement creates a tensile load path from the wireline 65 through the adaptor head 112, mandrel profile 114, collet fingers 108 and then the wireline tool 100. It will be understood that this connection is secured by the presence of the support sleeves 106,116 which must be simultaneously compressed to receive connection as well as disconnection.

When a tool is made-up as described above it can be lowered on the slickline in bore 57 to BOP 58 where shear rams 60 are actuated to partially suspend the tool and allow the adaptor head 112 to be disconnected and to be connected to another tool as described above. The tools have like coupling heads 112 in their bases which allow them to be coupled together to form a concatenated tool intervention string. The string may be broken up using a similar procedure of suspending the string in rams 60 and disconnecting and storing separate tools sequentially in their respective magazine products 54.

When the tools required to be disconnected, the made-up tool is again retrieved into the magazine housing. The rams 51 are actuated to a position as shown in FIG. 7*a*, thereby abutting the shoulders of the upper and lower support sleeve 106,116. This results in compression of the support sleeve spring 124,128, allowing the removal of the adaptor head 112 and storage of the wireline tool 100 in its magazine.

Thus, there is disclosed a lightweight autonomous intervention system for use with a lightweight vessel. The system may be deployed from a lightweight vessel, for example around 2000-2500 tonnes and the system being relatively lightweight, 35-40 tonnes, allow this to be achieved. The system contains all of the components necessary to provide well security with a double seal barrier as is required with conventional intervention systems. In the event of adverse weather conditions, there is provided an emergency quick disconnect which allows the umbilicals to be retrieved to surface with the intervention system being retained to provide appropriate sealing of the wellhead. In the event that the intervention system requires to be retrieved this can be done upstream of the valve means which leaves a sealed valve in position above the horizontal tree, thus providing a secondary well barrier.

Various modifications may be made to the embodiment of the autonomous well intervention system hereinbefore described without departing from the scope of the invention. For example, although the SLWIS is shown used with a horizontal tree, it may also be used with a conventional dural bore xmas tree when used with a dual bore selector valve, such as disclosed in EP Patent No. (GB) 0815341 (Dual Bore Riser).

In addition, the upper BOP 58 may be replaced by a conventional BOP but in this case the winch would be repositioned because the rams of the conventional BOP require greater horizontal space and would not be located within winch housing 62. The winch may be disposed upwards or downwards of the conventional BOP.

Furthermore the valve assembly 77 may have a different BOP instead of BOP 72. This may be replaced by an apertured ball valve as disclosed in applicant's corresponding published International Patent Application No. WO 00/15943 entitled Improved Ball Valve. This has the advantage that the ball valve 72 fits into the valve housing 79 and is hydraulically actuatable to provide a well barrier in the same way as BOP 72. Also, because the overall valve unit 77 diameter is unchanged, this embodiment can also receive a convention BOP to provide a secondary well barrier.

It will be appreciated that the winch may not be coaxial with the intervention wellbore. The drum may be vertically or horizontally aligned and may be separate from the wellbore 57. The wireline may be slickline or electric line or any other suitable line. It will be understood that the particular arrangement shown in the preferred embodiment is elegant and allows for the use of a readily manufactured single pressure retaining housing. The type and number of intervention tools may be varied as required. It is not essential that every magazine pocket or pod has an intervention tool, some pockets may be blanked off, and the intervention tools which is required to be run in the well can be installed in the particular pockets at surface. Other pockets not required can simply be blanked off. However, it is also possible that an existing pod may be replaced in situ by an ROV with another pod of a different tool or a blanked off plate may be removed and a new pocket containing a tool may be installed using an ROV. It will be understood that the tool magazine may be made of any suitable size as required to run a desired number of intervention tools. In a preferred arrangement, the magazine may hold up to sixteen tools, although this can be varied as required depending on the particular intervention required. The advantage of this arrangement is that it provides all the tools necessary for most interventions and removes the need to withdraw the entire intervention system to the surface for reloading.

It will be appreciated that the principal advantage of the embodiment hereinbefore described is that there is no rigid connection to surface, hence the deployment of the lightweight intervention system is less affected by adverse weather conditions than currently available systems. Furthermore, because a number of tools can be deployed in the tool magazine on surface which are envisaged as fulfilling all the intervention requirements, the wireline does not need to return to surface for a tool change. In addition, because the winch is not exposed to well fluids there is no need for a stuffing box and the problems associated with running a wireline through a stuffing box. Furthermore, sinker bars are not required nor is a pressure differential present. In addition, the provision of the upper-barrier seal has the advantage in that it provides a shoulder which allows tools to be hung off to create a string of tools to carry out multiple intervention tasks in a single intervention operation. The provision of the lower barrier, either BOP 72 or improved apertured ball valve, in a housing which can be left in-situ allows both retrieval of the SLWIS to surface in emergency conditions and allowing a conventional BOP to be placed in the valve assembly to provide a secondary barrier. The system can be readily deployed from lightweight vessels of about 2000 tonnes having an A-frame crane/deployment unit. As the system does not require continuous tool changes with the installation of extended guide posts it is not necessary to run guide wires which reduces operating time and minimises downtime due to weather conditions. As the winch and tool string are contained in a common pressure housing, this results in further advantages, for example: height and weight are reducing minimising environmental loading on the intervention and product systems; removal of the seal across the wire significantly reduces system pressure integrity and environmental pollution; the pressure and load effect on the wire and wire sealing is removed minimising frictional effects generated by the seal allowing lighter and short tool strings to be used, and reduces control and pumping systems required even in normal water depths and temperatures.

The invention claimed is:

1. A self contained well intervention system for use with a well intervention tool, said system comprising:

a well intervention housing having a tool magazine having a magazine housing, at least one magazine pocket for storing at least one deployable tool therein and a magazine chamber for assembling an intervention tool string therein, the magazine pockets being fixed in relation to the magazine housing, and the magazine housing having a housing base portion, the base portion being connected to a valve housing, a valve housing coupled to said magazine housing, said valve housing having a detachable valve means coupled thereto, said well intervention housing and said valve means each having a coupling means for coupling the intervention housing and said valve means to a top portion of a subsea xmas tree, said well intervention housing, said magazine housing, said housing base portion, said valve housing and valve means defining an intervention system throughbore for permitting passage of intervention tools, and tool selection and deployment means coupled to said well intervention housing and being remotely operable from the surface for selecting and retrieving a tool from said magazine and for deploying said tool through said intervention system throughbore into a wellbore.

2. A well intervention system as claimed in claim 1 wherein said magazine includes a plurality of tool compartments for receiving and storing a plurality of tools selectable from the surface.

3. A well intervention system as claimed in claim 1 wherein said intervention system includes a tool support means for supporting a selected tool permitting at least one other tool to be selected and coupled to said supported tool to provide a deployable tool string of at least two tools.

4. A well intervention system as claimed in claim 1 wherein said tool selection and deployment means includes a rotatable drum having a length of slickline or wireline wound thereon, a sheave for guiding the slickline or wireline from the drum to the tool and coupling means for coupling the slickline or wireline to the tool.

5. A well intervention system as claimed in claim 4 wherein said rotatable drum is coaxially mounted on said central bore.

6. A well intervention system as claimed in claim 4 wherein at least two separate lubricator conduits are provided, one conduit coupled between said drive housing and said sheave for conveying wire from the rotatable driver to the sheave, and another lubricator conduit coupled between the sheave and said tool magazine for deploying a tool string and wire from said sheave.

7. A well intervention system as claimed in claim 3 wherein said tool selection and deployment means includes coupling means adapted to be operated from the surface to retrieve a selected intervention tool from said magazine and to couple the selected tool to at least one other intervention tool in order to create a tool string to run the tools into the well, the coupling means also being actuatable from the surface to de-couple the tools to permit said tools to be replaced into the magazine.

8. A well intervention system as claimed in claim 1 wherein said tool magazine comprises a magazine housing, a plurality of tool magazine pockets coupled to and disposed about said housing, said tool magazine pockets each being adapted to receive at least one respective tool.

9. A well intervention system as claimed in claim 8 wherein said tool magazine pockets are radially disposed about said housing.

10. A well intervention system as claimed in claim 8 wherein said magazine pockets are releasably coupled to said housing whereby a particular magazine pocket can be removed and replaced by a blank plate means so as to vary the number of magazine pockets being deployed on a full magazine.

11. A well intervention system as claimed in claim 8 wherein said magazine pockets are selectively sealable and disconnectable from said magazine housing, whereby the same magazine pocket or a different pocket is connectable to said magazine housing.

12. A well intervention system as claimed in claim 8 wherein said tool magazine and said magazine pockets each have remotely actuatable means for moving a tool stored in the magazine pocket from a position of storage in said magazine to a coupling position for coupling to the tool selection and deployment means to assist the tool to be coupled to said tool selection and coupling means.

13. A well intervention system as claimed in claim 12 wherein said remotely actuatable means are used to lower the tools back into respective magazines after the tool has been used in well intervention.

14. A well intervention system as claimed in claim 12 wherein said remotely actuatable means are provided by hydraulically operated rams, each hydraulically operated ram being associated with a respective magazine pocket.

15. A well intervention system as claimed in claim 12 wherein the remotely actuatable means are provided by electrically or mechanically operable rams, each being associated with a respective magazine pocket.

16. A well intervention system as claimed in claim 1 wherein said valve means is coupled to said housing by locking means, said locking means being remotely actuatable from the surface.

17. A well intervention system as claimed in claim 16 wherein said locking means is hydraulically, mechanically or electrically operated.

18. A well intervention system as claimed in claim 17 wherein said locking means are operable by an ROV.

19. A well intervention system as claimed in claim 16 wherein said locking means are provided by a plurality of moveable dogs which pass through said valve housing and engage with said valve means.

20. A well intervention system as claimed claim 16 wherein said coupling means for coupling said valve means to the wellhead includes locking means for locking said valve means to the interior of the wellhead.

21. A well intervention system as claimed in claim 20 wherein said locking means is an axially moveable sleeve or mandrel and moveable dogs, whereby in response to axial movement of said sleeve the dogs are radially displaced to engage an inner profile of said wellhead and lock said valve means to said wellhead to allow the well intervention housing to be removed.

22. A tool selection and deployment means for use with a self-contained well intervention system, said tool selection and deployment means including remotely actuatable coupling means for controlling said tool selection and for selecting a particular intervention tool from a tool magazine for coupling the tool to a tool string for deployment in a well, said tool magazine having a magazine housing and at least one magazine pocket for storing at least one deployable tool, said magazine pocket being fixed in relation to the magazine housing, said magazine housing having a base portion for being connected to a wellbore housing, said coupling means being adapted to engage with an upper portion of the respective deployable tool to secure said deployable tool to said tool string.

23. Tool selection and deployment means as claimed in claim 22, wherein said tool selection and deployment includes support means for supporting at least one selected tool in a bore and allowing said coupling means to be separated from said tool to retrieve a further tool selected from said magazine to create a tool string with at least two deployable tools therein, said coupling means and said tool support means permitting separation of said selected tools after well intervention and restoring said tools in their respective magazines.

24. Tool selection and deployment means as claimed in claim 22 wherein said tool selection and deployment means includes a rotatable drum having a length of slickline or wireline wound thereon, a sheave for guiding slickline or wireline from the drum to the tool and coupling means for coupling the slickline or wireline to the tool and drive means.

25. Tool selection and deployment means as claimed in claim 22, wherein said drum is coaxially mounted on said central bore.

26. Tool selection and deployment means as claimed in claim 22 wherein at least two separate lubricator conduits are provided.

27. Tool selection and deployment means as claimed in claim 26 wherein at least one of said lubricator conduits is a small bore section.

28. Tool selection and deployment means as claimed in claim 24 wherein said rotatable drum and said tool string are disposed within a common pressurised housing.

29. Tool selection and deployment means as claimed in claim 24 wherein said rotatable drum and spool arrangement is mounted coaxial with said wellbore and driven from an external drive.

30. Tool selection and deployment means as claimed in claim 28 including a mechanical drive system for rotating said rotatable drum, said mechanical drive system being located outside said pressure container housing.

31. A tool magazine for use with a self-contained well intervention system, said tool magazine comprising a magazine housing, a plurality of magazine pockets coupled in a fixed relation to said tool magazine, each magazine pocket being adapted to receive a respective well intervention tool and each magazine pocket having actuation means for moving said tool from the magazine pocket to a position for engagement with a tool coupling means, said tool magazine having a magazine base portion for being connected to a wellbore housing of said intervention system.

32. A tool magazine as claimed in claim 31 wherein said magazine pockets are radially arranged around said magazine housing.

33. A tool magazine as claimed in claim 31 wherein said magazine pockets are partially inclined to a well axis.

34. A tool magazine as claimed in claim 31, wherein said magazine housing is substantially coaxial with the wellbore axis and each magazine pocket is adapted to contain an independent tool holder which is moveable to cross said wellbore axis.

35. A tool magazine as claimed in claim 31 wherein the length of each magazine pocket is adjustable to accommodate a variety of different tool lengths.

36. A tool magazine as claimed in claim 31, each magazine pocket having remotely actuatable means for moving a tool stored in a magazine pocket for a position of storage in said magazine to a coupling position for coupling to the tool selection and deployment means to assist the tool to be coupled to said tool selection and coupling means, said coupling position being substantially aligned with the vertical axis of the wellbore.

37. A tool magazine as claimed in claim 31 wherein the lower part of each pocket contains a hot-stab mechanism to allow coupling of a device for interrogation of logging tools.

38. A tool magazine as claimed in claim 31 wherein at least one of said magazine pockets is sealable by barrier seal to allow the tool in the magazine pocket to be changed by removing the magazine pocket from the magazine housing or removing the tool from the magazine pocket and replacement by another tool.

39. A tool magazine as claimed in claim 31 wherein said magazine pockets are releasably coupled to said housing whereby a particular magazine pocket can be removed and replaced by a blank plate so as to vary the number of magazine pockets being deployed in a magazine.

40. A well intervention system as claimed in claim 1 wherein said valve means is capable of being either a) retrieved with the system or b) remaining locked onto wellhead.

41. A well intervention system as claimed in claim 1 wherein said system incorporates a further well barrier wholly within the pressure boundary of the system.

42. A well intervention system as claimed in claim 1 wherein said detachable valve means is provided by an apertured ball valve.

43. A coupling system for use with a well intervention system for coupling tools disposed in a magazine of said well intervention system, said magazine having a magazine housing and at least one magazine pocket, said magazine pocket being in fixed relation to said magazine housing and said housing having a housing base portion connected to a wellbore housing of said well intervention system and for disposing said selected tools in an intervention tool string for use in well intervention, said coupling system comprising:

a coupling member adapted to be coupled to a wireline, said wireline being coupled to a rotatable winch drum which is controllable from surface to vary the position of the coupling means in said magazine;

a coupling head disposed on each deployable tool, said coupling head being disposed in a coupling position in response to the tool being selected and moved to said make-up position; and moveable support means within said magazine having shoulders for abutting said coupling member and for abutting said selected tool coupling head, the tool coupling means and the selected tool each having spring-biased latching means moveable between a first unlatched position when not in said make-up position to a second latching position when in said make-up position, whereby said coupling member is latchable to said coupling head of a respective tool in said make-up position.

44. A coupling system as claimed in claim 43 wherein the spring-biased latching means of the coupling head on each of the tools comprising a plurality of circumferentially disposed pivotable collet fingers which are biased into a first unlatched position when uncoupled and are biased into a second latching position when said coupling member and said coupling member to connect the coupling head of the respective selected tool.

45. A lubricator system for use with a well intervention system comprising:

at least first and second separate lubricator conduits, a sheave disposed between said conduits, the first conduit receiving a slickline or wireline, the second conduit sized for running a well tool for use in a well intervention system;

said second conduit leading from the sheave and connected to a magazine housing for a magazine of well tools, said second conduit formed around an axis and said first conduit disposed to be spaced from the axis, the slickline or wireline movable through said first conduit, around the sheave and through said second conduit to be operatively connected to a tool selected from the tool magazine.

* * * * *